US011294305B2

(12) United States Patent
Nagashima et al.

(10) Patent No.: US 11,294,305 B2
(45) Date of Patent: Apr. 5, 2022

(54) TONER CONVEYING DEVICE, AND IMAGE FORMING APPARATUS INCLUDING TONER CONVEYING DEVICE

(71) Applicant: KYOCERA Document Solutions Inc., Osaka (JP)

(72) Inventors: Teruhiko Nagashima, Osaka (JP); Naoki Mizutani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/443,708

(22) Filed: Jul. 27, 2021

(65) Prior Publication Data

US 2022/0035270 A1 Feb. 3, 2022

(30) Foreign Application Priority Data

Jul. 29, 2020 (JP) ..... JP2020-128327

(51) Int. Cl.
*G03G 15/08* (2006.01)
*G03G 21/18* (2006.01)

(52) U.S. Cl.
CPC ..... *G03G 15/0889* (2013.01); *G03G 21/1857* (2013.01); *G03G 21/186* (2013.01)

(58) Field of Classification Search
CPC ..... G03G 15/0812; G03G 15/0887; G03G 15/0889; G03G 21/1857; G03G 21/186; G03G 15/757
See application file for complete search history.

(56) References Cited

U.S. PATENT DOCUMENTS 9,658,570 B2 * 5/2017 Nagashima ..... G03G 15/0815
2012/0201575 A1 * 8/2012 Kashimoto ..... G03G 15/0812 399/272

FOREIGN PATENT DOCUMENTS

JP 2014006411 A 1/2014

* cited by examiner

*Primary Examiner* — Hoang X Ngo
(74) *Attorney, Agent, or Firm* — Alleman Hall Creasman & Tuttle LLP

(57) ABSTRACT

A toner conveying device that conveys toner. The toner conveying device includes a housing, a toner guide portion, and at least two vibration motors. The housing has, in its inside, a toner conveyance path. The toner guide portion is provided in the housing and includes an opening through which toner flows in or out, and a guide passage communicating between the opening and the toner conveyance path. The at least two vibration motors apply vibrations to the toner guide portion. The vibration motors are started at different timings, and driven and controlled by drive signals in which a first pulse and a second pulse of different pulse widths alternately continue.

5 Claims, 20 Drawing Sheets

TONER CONVEYING DEVICE, AND IMAGE FORMING APPARATUS INCLUDING TONER CONVEYING DEVICE

INCORPORATION BY REFERENCE

This application is based upon and claims the benefit of priority from the corresponding Japanese Patent Application No. 2020-128327 filed on Jul. 29, 2020, the entire contents of which are incorporated herein by reference.

BACKGROUND

The present disclosure relates to a toner conveying device for conveying toner.

A developing device is installed in an image forming apparatus, such as a copier or a printer, that forms an image on a sheet member such as a print sheet by an electrophotographic system. Developer containing toner is stored inside the developing device. The developing device develops an electrostatic latent image formed on an image carrier, such as a photoconductor drum, with the toner included in the developer. The toner inside the developing device decreases as the developing is performed. Accordingly, the image forming apparatus includes a toner case storing the toner, and the toner is replenished from the toner case to the developing device. The image forming apparatus is provided with a toner conveying device that conveys the toner from the toner case to the developing device. A toner receiving portion is provided in a housing of the toner conveying device. The toner receiving portion receives the toner supplied from the toner case and guides the toner to a toner conveyance path in the apparatus. In this configuration, when the toner passes through the toner receiving portion, the toner may adhere and deposit on an inner surface of a guide passage of the toner receiving portion, and the deposited toner may interfere the toner from flowing through the guide passage. There is known a conventional toner conveying device including, as a configuration to remove the deposit, a removal member that comes in contact with the inner surface of the guide passage to collapse and remove the deposit.

However, since the removal member physically contacts the inner surface of the guide passage, the removal member may be deteriorated due to fatigue, and its removal effect may be decreased. In addition, the toner may deposit on the removal member itself, resulting in worsening of the toner flow in the guide passage.

In addition, there is known a developing device that uses a vibration motor to restrict deposition of the toner in a casing. In the developing device, the vibration motor is attached to the toner receiving portion of the toner conveying device, thereby to restrict deposition of the toner in the internal guide passage.

SUMMARY

A toner conveying device according to an aspect of the present disclosure is a toner conveying device that conveys toner. The toner conveying device includes a housing, a toner guide portion, and at least two vibration motors. The housing has, in its inside, a toner conveyance path. The toner guide portion is provided in the housing and includes an opening through which toner flows in or out, and a guide passage communicating between the opening and the toner conveyance path. The at least two vibration motors apply vibrations to the toner guide portion. The vibration motors are started at different timings, and driven and controlled by drive signals in which a first pulse and a second pulse of different pulse widths alternately continue.

An image forming apparatus according to another aspect of the present disclosure includes the toner conveying device, a developing device, and a control portion. The developing device performs developing by using the toner supplied from the toner conveying device. The control portion starts the vibration motors at different timings, and drives and controls the vibration motors by the drive signals in which the first pulse and the second pulse of different pulse widths alternately continue.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes embodiments of the present disclosure with reference to the accompanying drawings. It should be noted that the following embodiments are examples of specific embodiments of the present disclosure and should not limit the technical scope of the present disclosure.

First Embodiment

Figure 1:
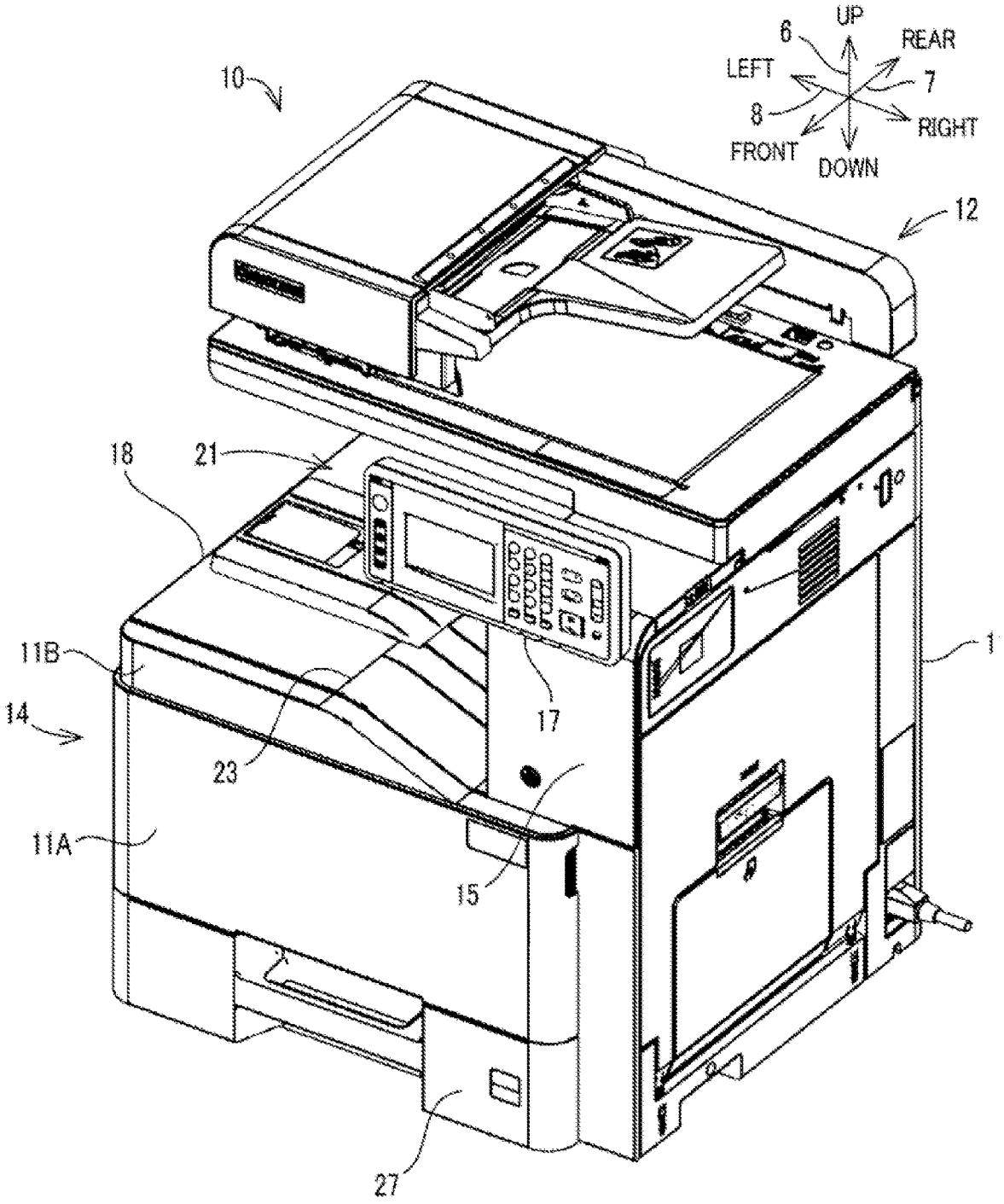
FIG. 1 is a perspective diagram of an image forming apparatus according to an embodiment of the present disclosure.

The following describes a first embodiment of the present disclosure with reference to the accompanying drawings. FIG. 1 is a diagram showing a configuration of an image forming apparatus 10 according to an embodiment of the present disclosure. It is noted that, for the sake of explanation, a vertical direction in a state where the image forming apparatus 10 is usably installed (the state shown in FIG. 1), is defined as an up-down direction 6. In addition, a front-rear direction 7 is defined on the supposition that a side at which an operation/display portion 17 is provided is the front. In addition, a left-right direction 8 is defined on the basis of the front of the usably installed image forming apparatus 10.

[Image Forming Apparatus 10]

The image forming apparatus 10 has at least a print function. As shown in FIG. 1, the image forming apparatus 10 is a color printer of what is called a tandem type. The image forming apparatus 10 prints an image on a sheet member such as a print sheet by using developer that includes toner. It is noted that the image forming apparatus 10 only needs to be an apparatus having a print function, and may be, for example, a multifunction peripheral having a plurality of functions including the print function, a facsimile apparatus, or a copier. Of course, the image forming apparatus 10 is not limited to the one for forming a color image, but may be one for forming a monochrome image.

The image forming apparatus 10 includes an image reading portion 12 and an image forming portion 14. The image reading portion 12 performs a process of reading an image from a document sheet, and is provided in an upper portion of the image forming apparatus 10. The image forming portion 14 performs a process of forming a color image based on an electrophotographic system, and is provided in a lower portion of the image forming apparatus 10. In addition, a sheet discharge portion 15 is provided on the right side of the image forming portion 14.

A discharge space 21 is provided between the image forming portion 14 and the image reading portion 12. The sheet discharge portion 15 couples the image forming portion 14 with the image reading portion 12 in the vertical direction, while forming the discharge space 21 between the image forming portion 14 and the image reading portion 12.

The sheet discharge portion 15 discharges a sheet member with an image formed thereon to the discharge space 21. On the left side surface of the sheet discharge portion 15 that faces the discharge space 21, a sheet discharge port 15A (see FIG. 3) is formed. The sheet discharge port 15A is formed to be higher in position than an end portion 24 of a sheet tray 18 that is described below. The sheet member is discharged from the sheet discharge port 15A.

The image forming portion 14 includes a housing 11 as an apparatus main body. The components constituting the image forming portion 14 are arranged in the housing 11. The housing 11 includes an exterior frame and an internal frame, wherein the exterior frame covers the whole image forming portion 14, and the internal frame supports the components constituting the image forming portion 14. The housing 11, as a whole, has an approximately rectangular parallelepiped shape.

Figure 2:
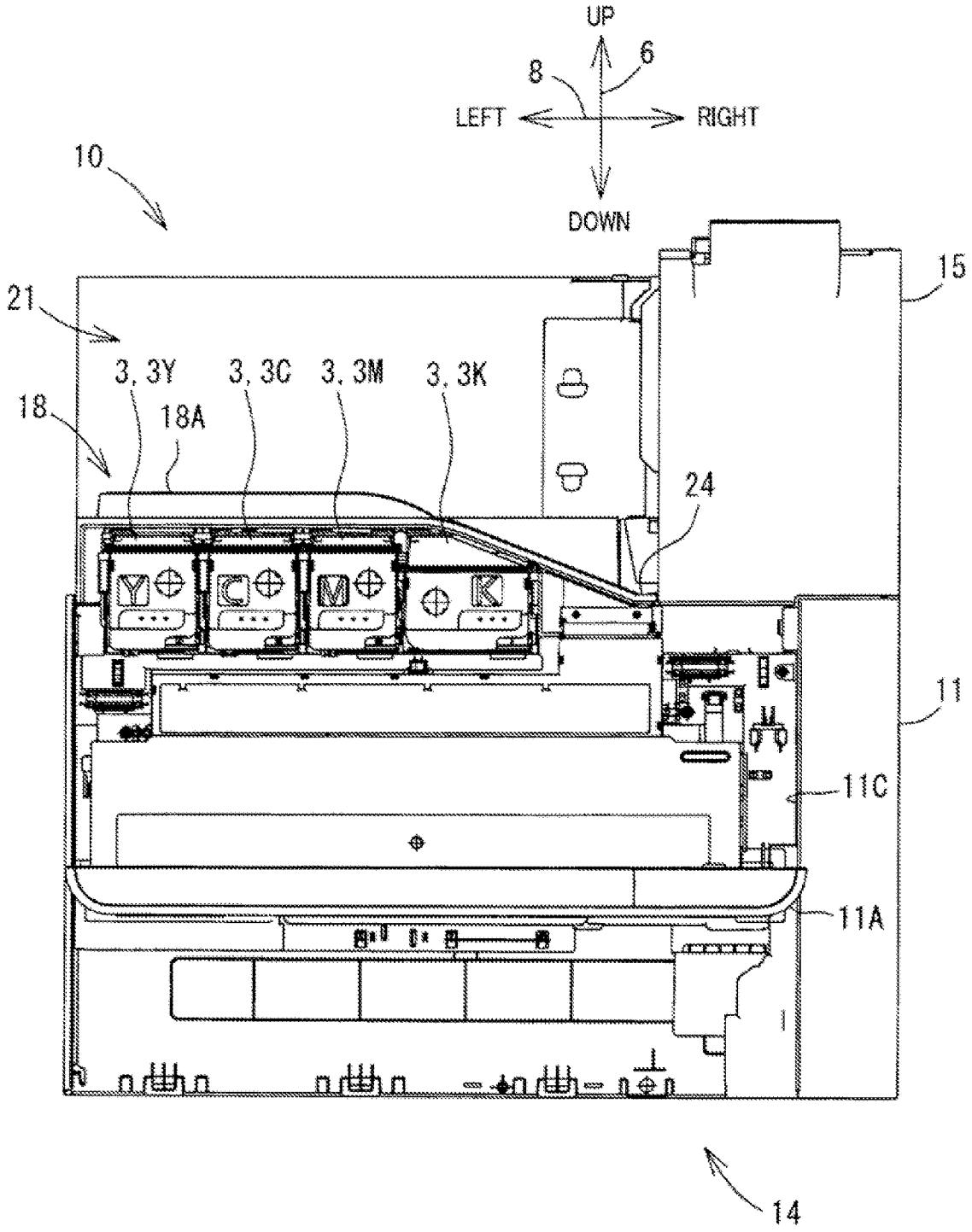
FIG. 2 is a front diagram showing a state where a front cover of a housing of the image forming apparatus is open.

The housing 11 includes a front cover 11A and a side cover 11B. An opening 11C (see FIG. 2) formed in a front surface of the housing 11 is covered with the front cover 11A and the side cover 11B. When the front cover 11A is open, the inside of the image forming portion 14 is exposed (see FIG. 2). The side cover 11B is provided above the front cover 11A. An upper portion of the opening 11C that is not closed by the front cover 11A is closed by the side cover 11B. FIG. 2 shows a state where the side cover 11B has been removed, and the front cover 11A is open. A toner container (s) 3 (toner case) is attached to the inside of the housing 11 through the opening 11C.

Figure 3:
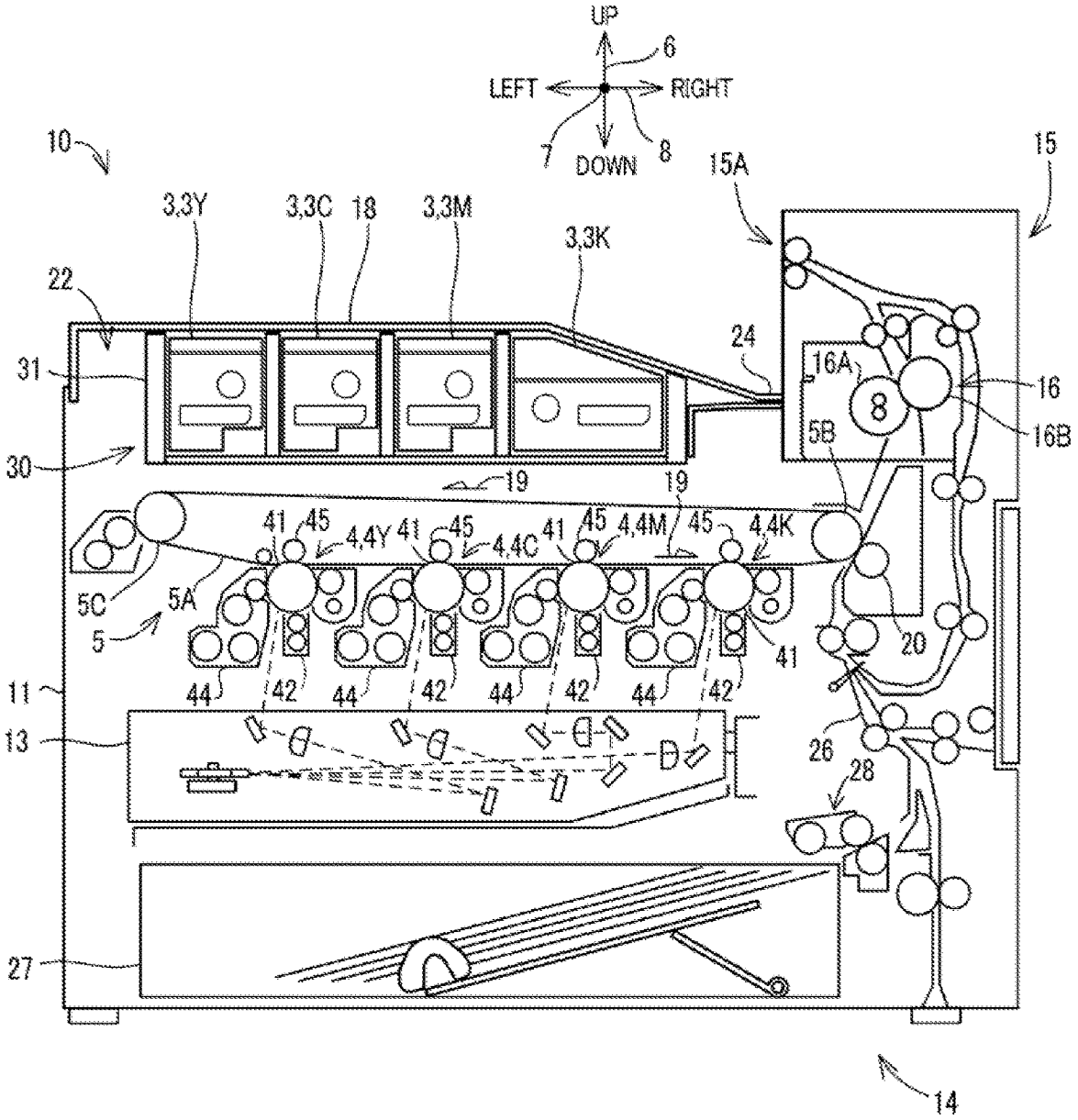
FIG. 3 is a diagram showing an internal configuration of an image forming portion provided in the image forming apparatus.

FIG. 3 is a diagram showing an internal configuration of the image forming portion 14. In FIG. 3, the image reading portion 12 is omitted. The image forming portion 14 forms, by what is called a tandem system, a color image on a sheet member such as a print sheet. As shown in FIG. 3, the image forming portion 14 includes four image forming units 4, an intermediate transfer unit 5, a laser scanning unit 13, a secondary transfer roller 20, a fixing device 16, the sheet tray 18, a sheet cassette 27, a sheet feed unit 28, the operation/display portion 17 (see FIG. 1), a conveyance path 26, a container attachment portion 30, a toner conveying device 60 (an example of a toner conveying device of the present disclosure), and a control portion 35 (an example of a control portion of the present disclosure).

The sheet feed unit 28 picks up, one by one, sheet members stacked on the sheet cassette 27, and feeds the sheet member toward the conveyance path 26, wherein the sheet members are recording media.

The image forming units 4 (4Y, 4C, 4M and 4K) are provided below the intermediate transfer unit 5. The plurality of image forming units 4 are arranged in alignment along the left-right direction 8 that approximately matches the running direction (the direction indicated by the arrow 19) of a transfer belt 5A. In order from left to right of the transfer belt 5A, the image forming unit 4Y for yellow color, the image forming unit 4C for cyan color, the image forming unit 4M for magenta color, and the image forming unit 4K for black color are disposed in the stated order.

Each of the image forming units 4 includes a photoconductor drum 41, a charging device 42, a developing device 44, and a primary transfer roller 45. The image forming units 4 form toner images on the surfaces of the photoconductor drums 41 by the electrophotographic system, and transfer the toner images to the transfer belt 5A provided in the intermediate transfer unit 5 by overlaying the toner images sequentially onto the transfer belt 5A. The transfer belt 5A is configured to move in the direction indicated by the arrow 19, and the toner images are sequentially transferred to the transfer belt 5A while it is moving. The image forming unit 4Y forms a toner image on the surface of the photoconductor drum 41 by using yellow toner. The image forming units 4C, 4M and 4K form toner images on the surfaces of the photoconductor drums 41 by using cyan toner, magenta toner, and black toner, respectively. The developing devices 44 perform the developing process of developing the toner images on the photoconductor drums 41.

Figure 4:
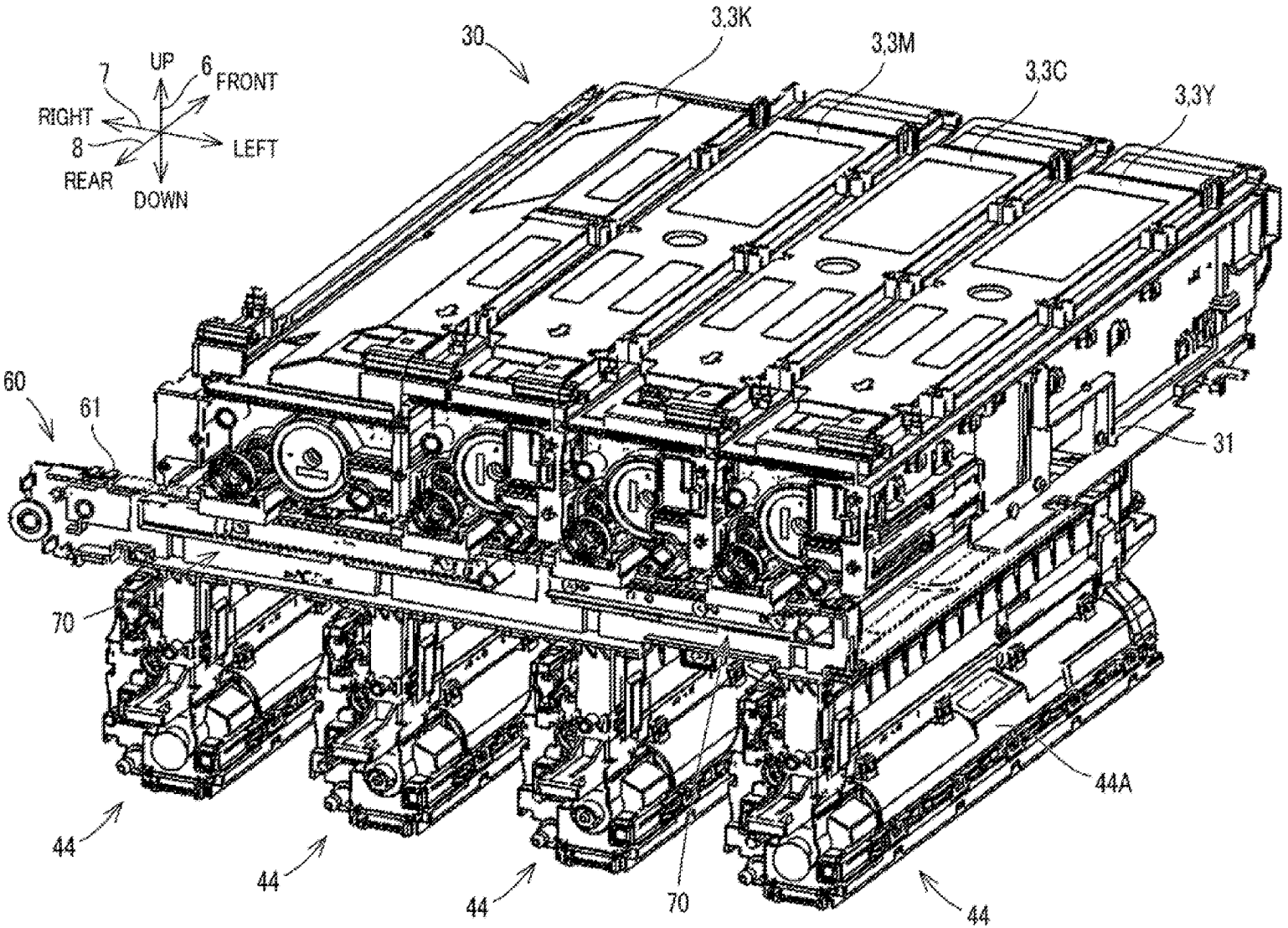
FIG. 4 is a perspective diagram of a container attachment portion, a toner conveying device, and developing devices viewed from diagonally above in rear.
Figure 5:
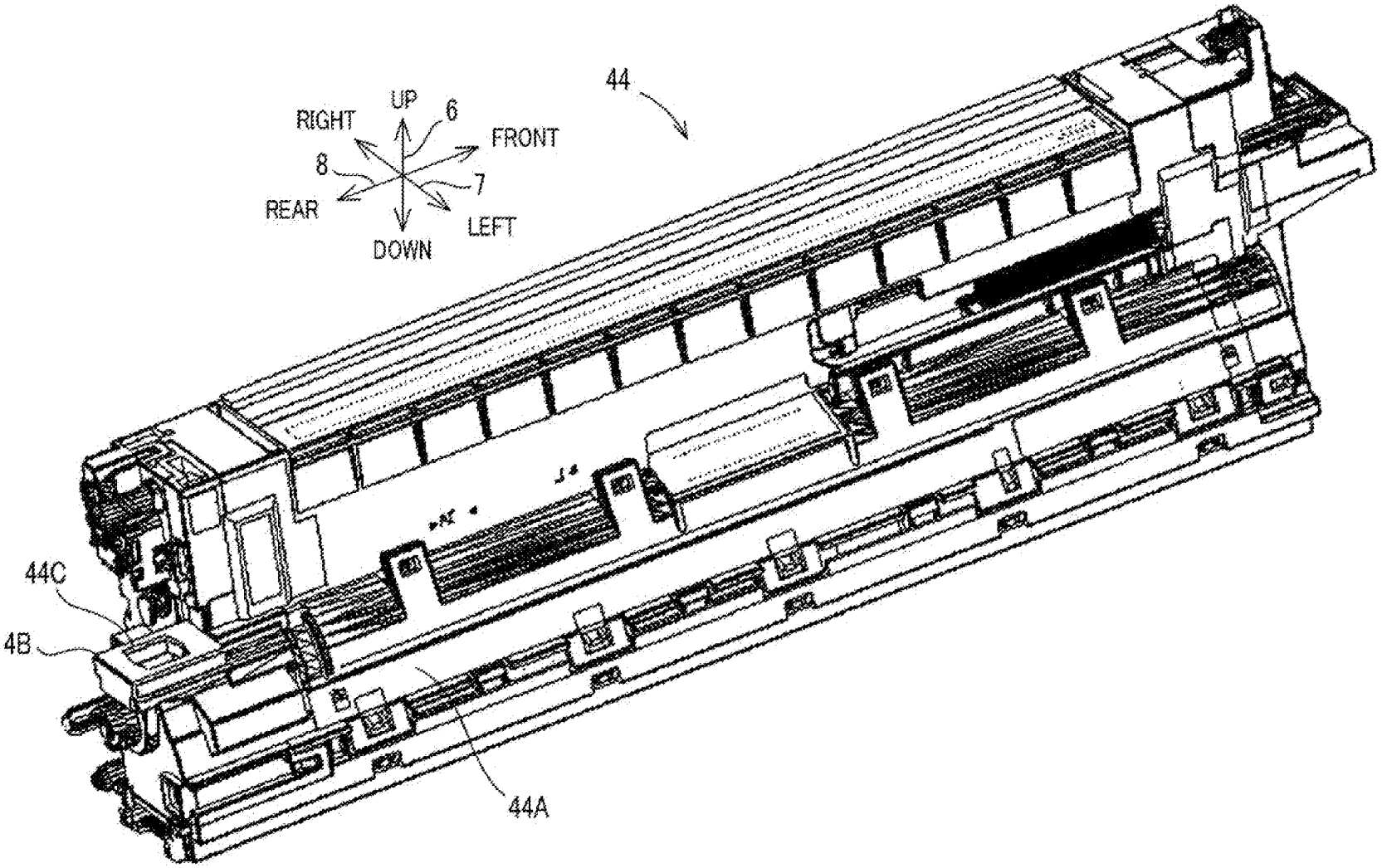
FIG. 5 is a perspective diagram showing the developing device provided in the image forming apparatus.

The developing device 44 performs the developing using the developer containing the toner. FIG. 4 is a perspective diagram of the container attachment portion 30, the toner conveying device 60, and the developing devices 44 viewed from the rear side. FIG. 5 is a perspective diagram showing the developing device 44. As shown in FIG. 4 and FIG. 5, the developing device 44 is formed to be elongated in the front-rear direction 7. A case main body 44A of the developing device 44 includes a toner replenishing portion 44B (an example of a toner replenishing device of the present disclosure, see FIG. 5). A replenishment port 44C (see FIG. 5) is formed in the toner replenishing portion 44B. As shown in FIG. 5, the toner replenishing portion 44B is provided at an end of the case main body 44A in its longitudinal direction. Specifically, the toner replenishing portion 44B is provided at a rear end of the case main body 44A in a state where the developing device 44 is attached to the inside of the housing 11.

The developing device 44 is attachable to and detachable from the housing 11 so as to be replaceable. The internal frame of the housing 11 is provided with support tables (not shown) that support the developing devices 44. In a state where the developing device 44 is attached to a support table, the toner is supplied, via the replenishment port 44C, to the inside of the developing device 44 by the toner conveying device 60 that is described below.

As shown in FIG. 3, the intermediate transfer unit 5 is provided above the image forming units 4 and below the container attachment portion 30. The intermediate transfer unit 5 includes the transfer belt 5A, a driving roller 5B, and a driven roller 5C. The transfer belt 5A is a belt member to which are transferred toner images of four colors formed on the photoconductor drums 41 of the image forming units 4. The transfer belt 5A is provided above the photoconductor drums 41. The transfer belt 5A is an endless, annular belt. The transfer belt 5A is pivotably supported by the driving roller 5B and the driven roller 5C that are provided separated from each other in the left-right direction 8. The transfer belt 5A is supported in such a way as to be stretched over the driving roller 5B and the driven roller 5C. When the transfer belt 5A passes through between the photoconductor drums 41 and the primary transfer roller 45, the toner images are transferred from the photoconductor drums 41 to the surface of the transfer belt 5A by being sequentially overlaid on the surface.

The laser scanning unit 13 irradiates a laser beam to the photoconductor drums 41 of the image forming units 4 based on input image data of respective colors. This allows electrostatic latent images to be formed on the photoconductor drums 41.

The secondary transfer roller 20 is disposed to face the driving roller 5B across the conveyance path 26 that extends in the vertical direction. The toner image on the transfer belt 5A is transferred to a sheet member by a transfer potential applied to the secondary transfer roller 20. The sheet to which the toner image has been transferred is conveyed to the fixing device 16.

The fixing device 16 fixes the toner image transferred on the sheet member, to the sheet member by heating it. The fixing device 16 includes a heating roller 16A and a pressure roller 16B. The sheet member conveyed to the fixing device 16 is conveyed while held between the heating roller 16A and the pressure roller 16B. During this conveyance, the toner image transferred to the sheet member is heated by the heating roller 16A. This allows the toner image to be fixed to the sheet member. Subsequently, the sheet member is discharged to the sheet tray 18 by the sheet discharge portion 15.

As shown in FIG. 3, the sheet tray 18 is provided in the discharge space 21. The sheet tray 18 holds sheet members that have passed through the fixing device 16 and have been discharged to the outside from the sheet discharge port 15A of the sheet discharge portion 15. The sheet tray 18 also serves as an exterior frame that constitutes an upper surface of the image forming portion 14. The sheet members discharged to the sheet tray 18 are stacked upward thereon. A plurality of ribs 18A (see FIG. 2) are formed to extend in the left-right direction 8 on an upper surface (a sheet placement surface) of the sheet tray 18. The sheet members discharged to the sheet tray 18 are supported by upper ends of the ribs 18A.

The container attachment portion 30 holds the four toner containers 3 that store the toner. As shown in FIG. 3, the container attachment portion 30 is provided above the intermediate transfer unit 5. A storage space 22 is formed between the intermediate transfer unit 5 and the sheet tray 18, and the container attachment portion 30 is provided in the storage space 22. That is, the sheet tray 18 is provided above the container attachment portion 30, and the intermediate transfer unit 5 is provided below the container attachment portion 30. The container attachment portion 30 is described in detail below.

The toner conveying device 60 conveys the toner supplied from the toner containers 3 attached to the container attachment portion 30, to the developing devices 44. As shown in FIG. 4, the toner conveying device 60 is provided more on the rear side than the container attachment portion 30 and the developing devices 44. The toner conveying device 60 is described in detail below.

[Container Attachment Portion 30]

Figure 6:
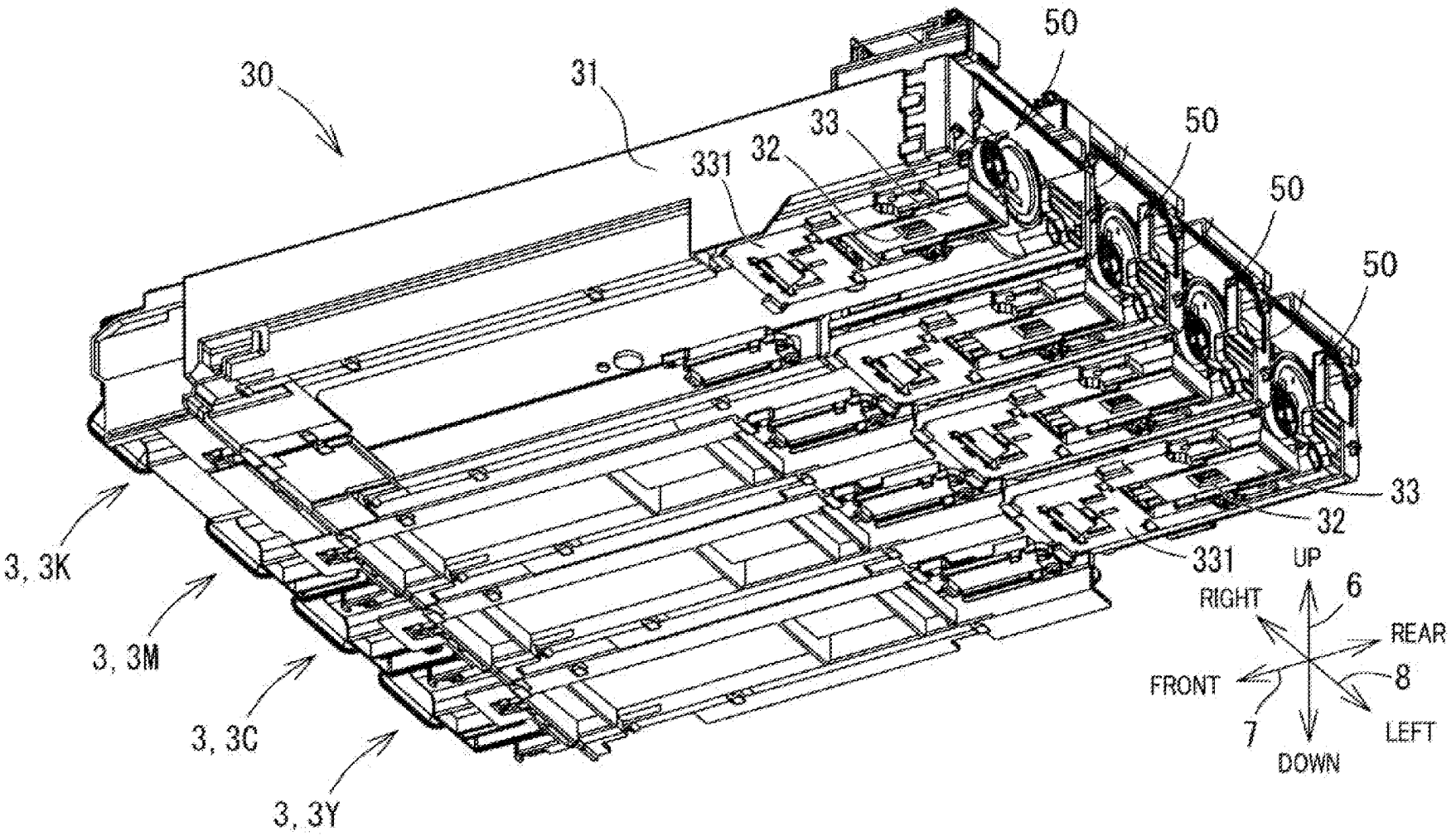
FIG. 6 is a perspective diagram of the container attachment portion viewed from diagonally below in rear.

FIG. 6 is a perspective diagram of the container attachment portion 30 viewed from diagonally below in rear. Both FIG. 4 and FIG. 6 show a state where the toner containers 3 are attached to the container attachment portion 30. The container attachment portion 30 is fixed to the internal frame of the housing 11. The container attachment portion 30 is configured such that a plurality of toner containers 3 (toner cases) can be attached thereto in a detachable manner. That is, the toner containers 3 are attached to the image forming apparatus 10 in a detachable manner through the container attachment portion 30.

The container attachment portion 30 includes a support frame 31 that supports the toner containers 3 for respective colors so that the toner containers 3 can slide in the front-rear direction 7. In the support frame 31, the toner containers 3 for respective colors are disposed in parallel along the left-right direction 8.

[Toner Containers 3]

As shown in FIG. 6, the toner containers 3 are each formed to be elongated in the front-rear direction 7. The four toner containers 3 store toner of colors that respectively correspond to the four image forming units 4. Specifically, the toner container 3K stores black toner, the toner container 3M stores magenta toner, the toner container 3C stores cyan toner, and the toner container 3Y stores yellow toner. Since the toner container 3K stores black toner that is consumed most, the toner container 3K is formed to be larger in horizontal width and capacity than the other toner containers 3 (3Y, 3C and 3M).

Each toner container 3 has a toner discharge port 32 formed at the rear side of a bottom portion thereof, and is further provided with a shutter member 33 for opening and closing the toner discharge port 32. The shutter member 33 is supported by a shutter support member 331 attached to the bottom portion of the toner container 3, in such a way as to be slidable between an opening position and a closing position. When the toner container 3 is attached to the container attachment portion 30, the shutter member 33 slides to the opening position to open the toner discharge port 32.

A transmission portion 50 is provided at the rear end of the toner container 3. The transmission portion 50 is configured to receive a rotational driving force input from the image forming apparatus 10 in an attachment state where the toner container 3 is attached to the container attachment portion 30. The transmission portion 50 includes a coupling member, a gear, and the like. In the attachment state, the transmission portion 50 is coupled with a joint (not shown) provided in the container attachment portion 30. In addition, the transmission portion 50 is coupled with a spiral conveyance member 34 (see FIG. 7) provided inside the toner container 3. With this configuration, when the rotational driving force is input to the transmission portion 50 in the attachment state, the transmission portion 50 rotates the conveyance member 34. This allows the toner inside the toner container 3 to be conveyed toward the toner discharge port 32.

The container attachment portion 30 of the image forming apparatus 10 is provided with a replenishment motor 51 (see FIG. 18) for replenishing the toner. The replenishment motor 51 rotationally drives the conveyance member 34 by supplying the rotational driving force to the transmission portion 50. The replenishment motor 51 is driven and controlled by the control portion 35. The replenishment motor 51 may be composed of a plurality of motors in correspondence with the number of the toner containers 3, or may be one motor that supplies the rotational driving force to the transmission portion 50 of each of the toner containers 3.

The toner stored in the toner container 3 is supplied through the toner discharge port 32 to the toner conveying device 60 described below. The toner is then conveyed to the replenishment port 44C (see FIG. 5) of the developing device 44 that corresponds to the color of the toner, and is replenished to the inside of the developing device 44 through the replenishment port 44C.

The control portion 35 controls the operation of the image forming apparatus 10 and the toner conveying device 60. The control portion 35 includes control equipment such as a CPU, a ROM, and a RAM. The CPU is a processor configured to execute various calculation processes. The ROM is a nonvolatile storage medium storing control programs for causing the CPU to execute the various calculation processes. The RAM is a volatile or nonvolatile storage medium storing various types of information. The control portion 35 may be realized by, for example, an IC such as an ASIC.

Figure 18:
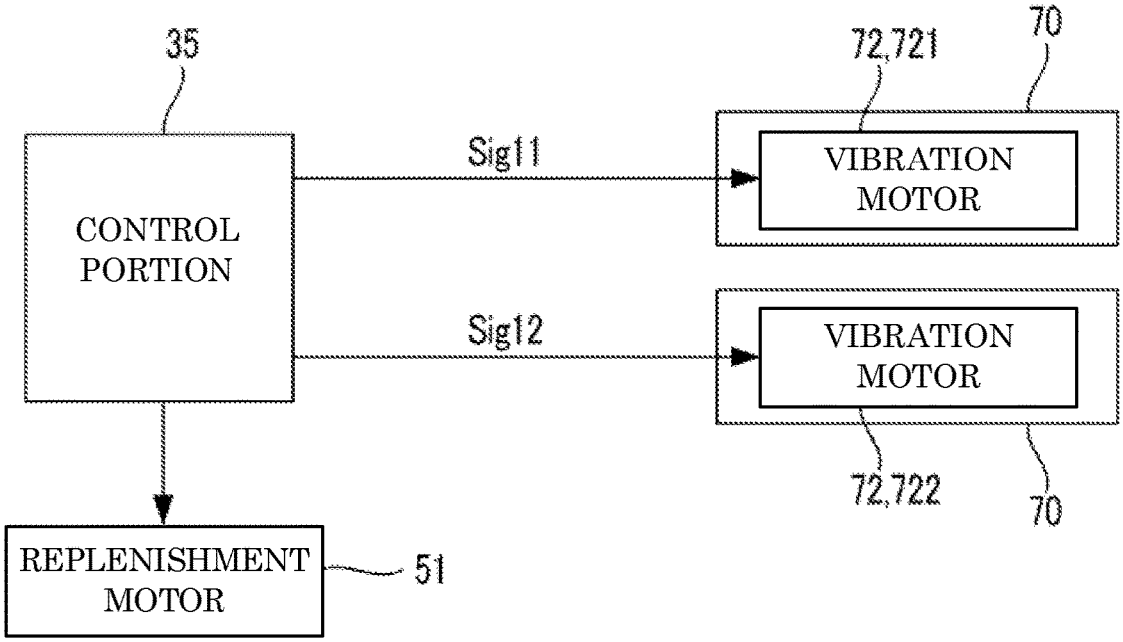
FIG. 18 is a block diagram showing a connection relationship between a control portion and vibration motors.

As shown in FIG. 18, the control portion 35 is connected to a plurality of vibration motors 72 (721, 722) provided in the toner conveying device 60. In addition, the control portion 35 is connected to the replenishment motor 51 provided in the container attachment portion 30. The control portion 35 supplies drive signals to the vibration motors 72 and the replenishment motor 51 to drive them.

[Toner Conveying Device 60]

Figure 7:
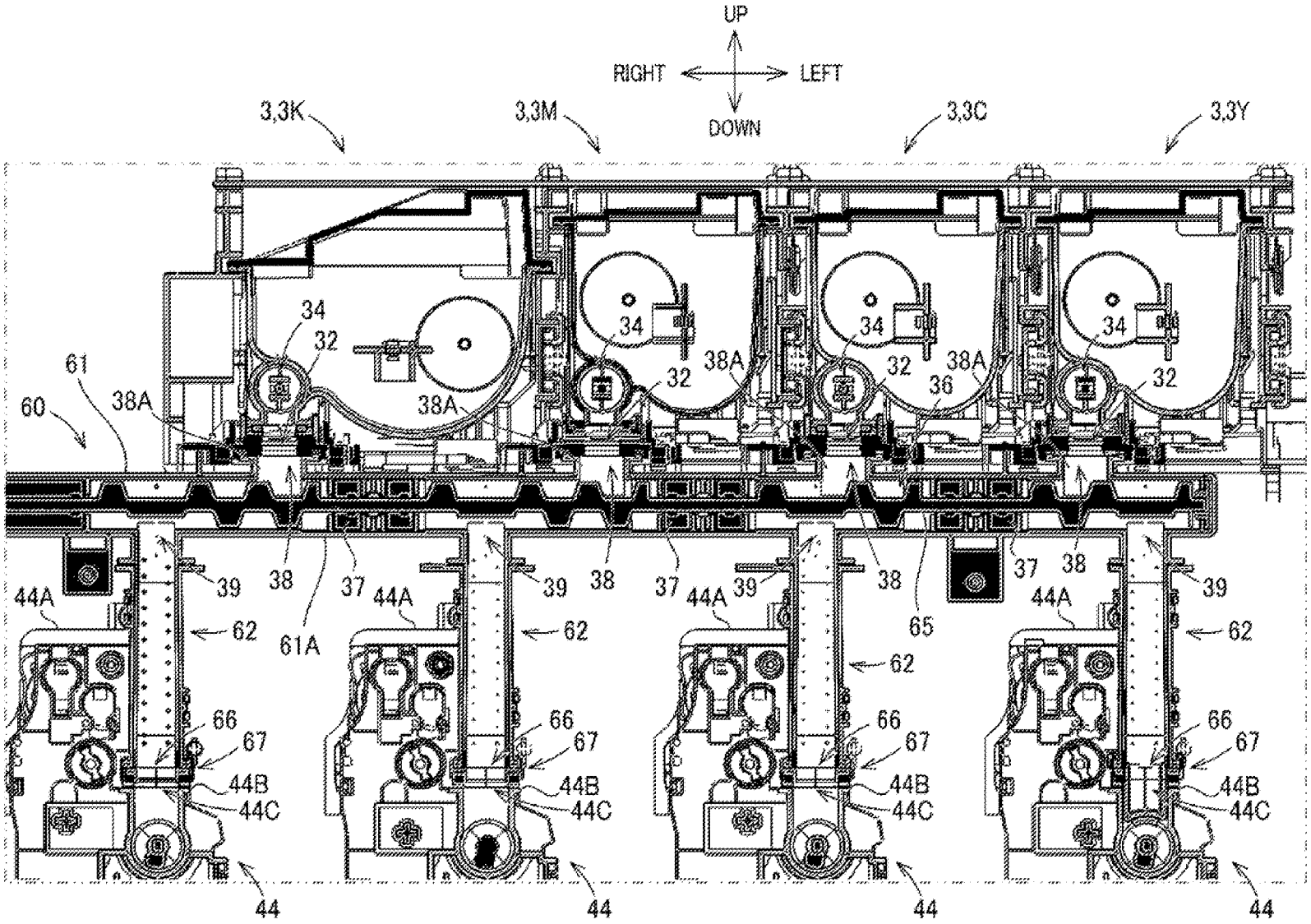
FIG. 7 is a cross-sectional diagram showing a cross-sectional structure of the toner conveying device and the developing device.
Figure 8:
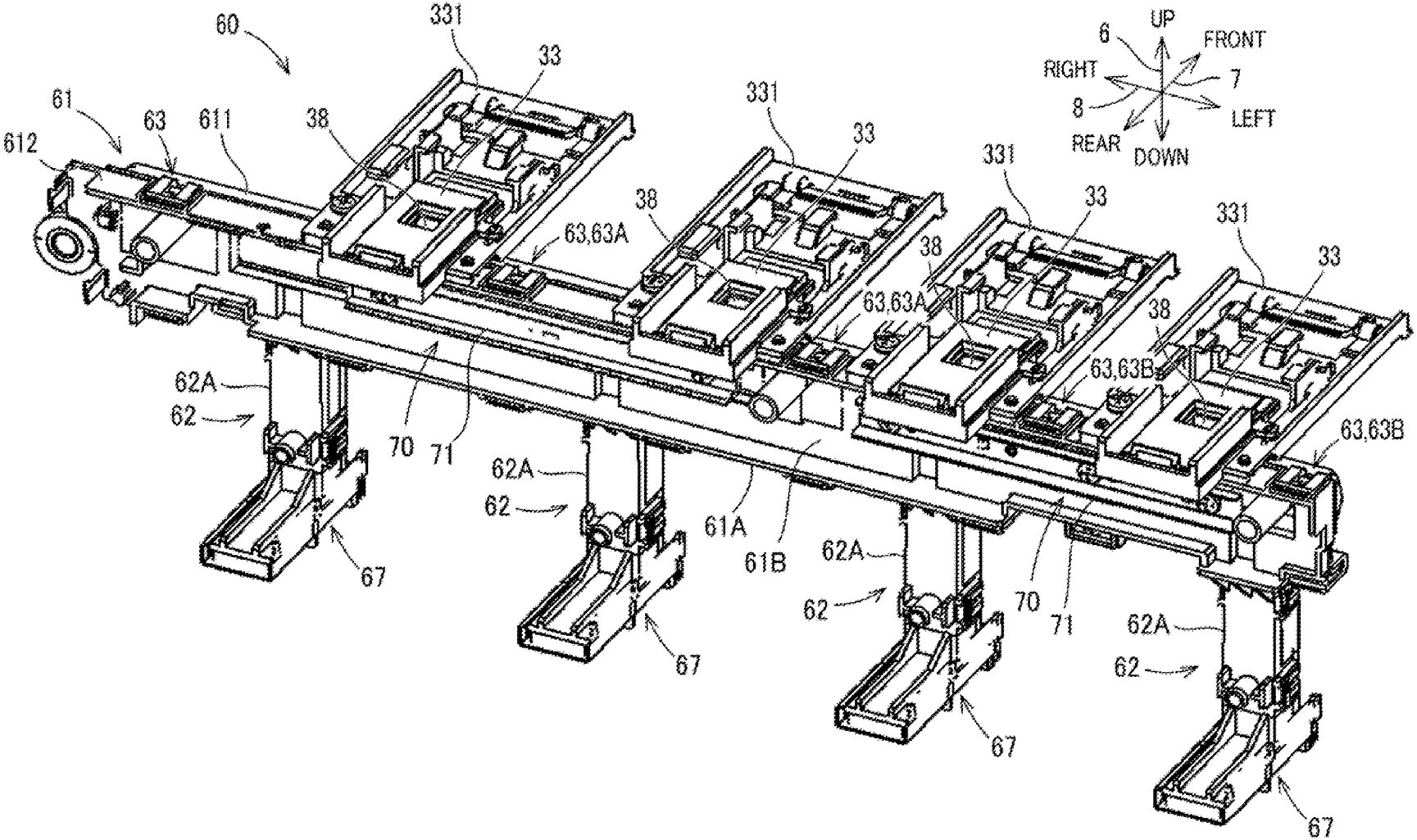
FIG. 8 is a perspective diagram of the toner conveying device viewed from the rear side.
Figure 9:
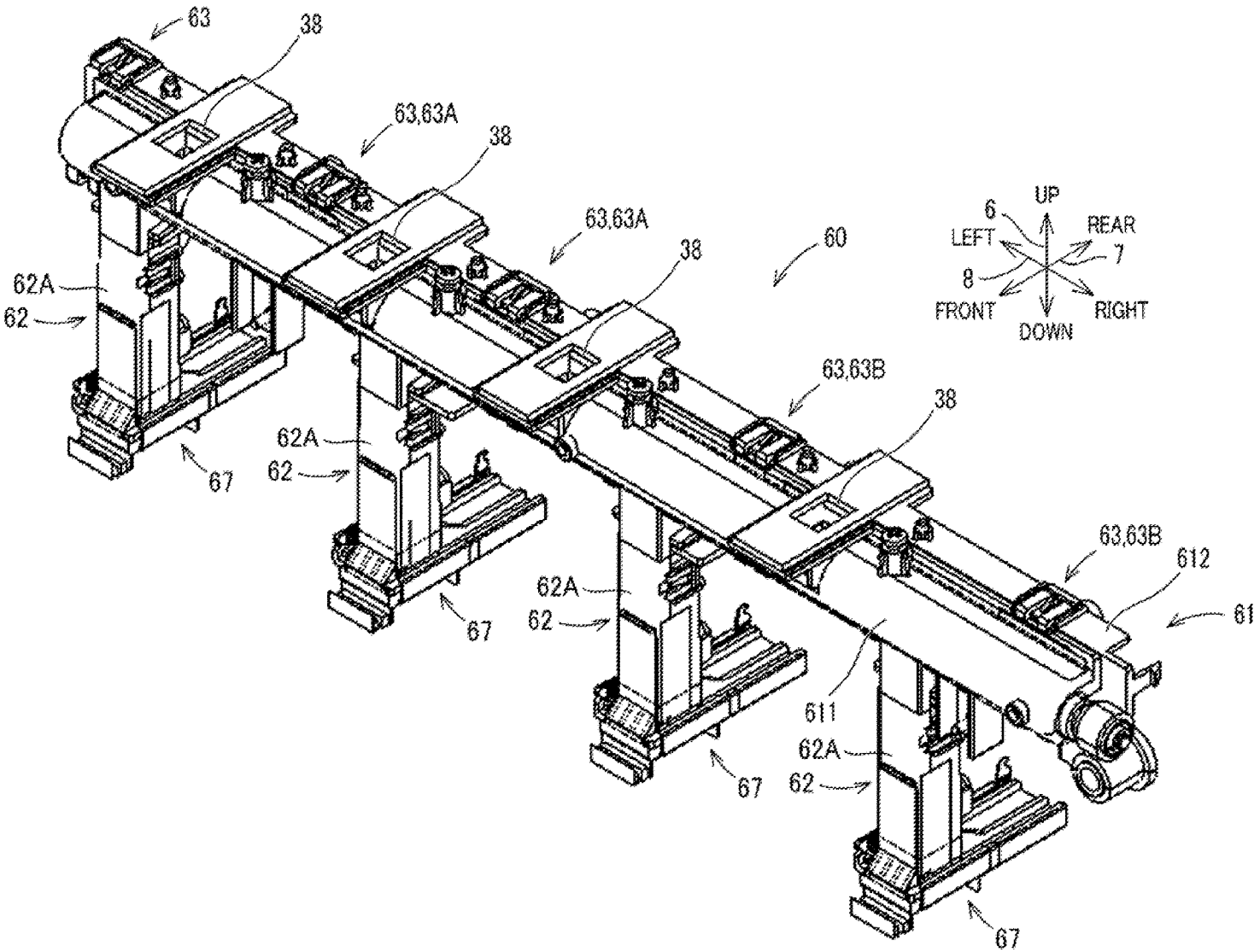
FIG. 9 is a perspective diagram of the toner conveying device viewed from the front side.
Figure 10:
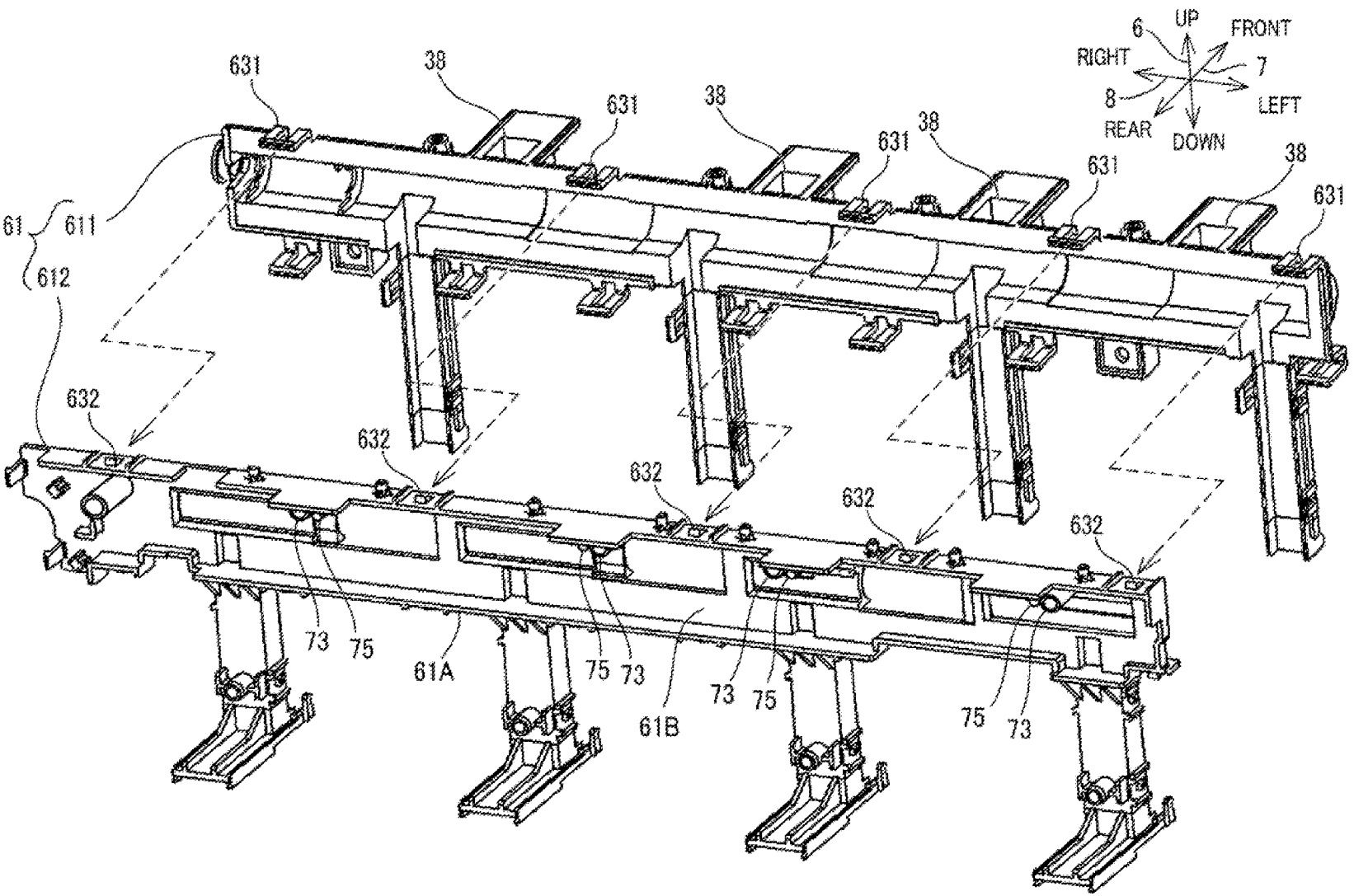
FIG. 10 is an exploded perspective diagram of a casing included in the toner conveying device.

FIG. 7 is a cross-sectional diagram of the toner conveying device 60, the container attachment portion 30, and the developing device 44 viewed from the rear side, taken along a cut plane that passes through a toner conveyance path 36 of the toner conveying device 60. FIG. 8 and FIG. 9 are perspective diagrams showing a configuration of the toner conveying device 60. FIG. 8 is a perspective diagram of the toner conveying device 60 viewed from the rear side. FIG. 9 is a perspective diagram of the toner conveying device 60 viewed from the front side. FIG. 10 is an exploded perspective diagram of a casing 61 included in the toner conveying device 60. It is noted that in FIG. 8, the shutter support member 331 and the shutter member 33 included in each toner container 3 are shown.

The toner conveying device 60 is provided at the rear side of the container attachment portion 30 and the developing device 44. The toner conveying device 60 conveys the toner supplied from the toner discharge port 32 of each toner container 3 to the replenishment port 44C of the developing device 44, and replenishes the toner to the inside of the developing device 44 through the replenishment port 44C.

As shown in FIG. 8 and FIG. 9, the toner conveying device 60 includes the casing 61 (an example of a housing of the present disclosure), four toner guides 62, a conveyance member 65, and two vibration units 70.

The casing 61 is formed from synthetic resin, and is formed from, for example, ABS resin. The casing 61 is formed to be elongated in the horizontal direction (left-right direction 8). The casing 61 is composed of a first casing 611 (an example of a first divided housing) and a second casing 612 (an example of a second divided housing), wherein the first casing 611 is a housing on the front side, and the second casing 612 is a housing on the rear side. Each of the first casing 611 and the second casing 612 is formed to be elongated in the left-right direction 8, dividing the casing 61 in the short direction (front-rear direction 7) perpendicular to the longitudinal direction of the casing 61. The first casing 611 and the second casing 612 are coupled with each other in the short direction to form the casing 61.

Five coupling portions 63 (an example of a coupling member) are provided on an upper portion of the casing 61. As shown in FIG. 10, the coupling portions 63 are a coupling member that couples the first casing 611 and the second casing 612 with each other, and have what is called a snap-fitting structure. In the present embodiment, among the five coupling portions 63, four coupling portions 63 (63A, 63B) at the left side of the casing 61 are disposed in the vicinity of reception ports 38 and guide passages 38A that are described below.

Each of the coupling portions 63 includes a projection piece 631 and a locking claw 632, wherein the projection piece 631 is provided on an upper portion of the first casing 611, and the locking claw 632 is provided on an upper portion of the second casing 612. The projection piece 631 has an insertion hole in which the locking claw 632 is inserted when the first casing 611 and the second casing 612 are coupled with each other. When the first casing 611 and the second casing 612 are positioned and joined to each other in the short direction, the locking claws 632 are inserted in the insertion holes of the corresponding projection pieces 631. This allows the projection pieces 631 and the locking claws 632 to be coupled strongly with each other, namely, the first casing 611 and the second casing 612 are coupled with each other. It is noted that coupling portions (not shown) having the same configuration as the coupling portions 63 are provided on a lower portion of the casing 61, too.

As shown in FIG. 7, the toner conveyance path 36 along which the toner is conveyed, is provided in the inside of the casing 61. The toner conveyance path 36 is configured to convey the toner supplied from the toner containers 3 to the developing devices 44. In the present embodiment, the toner conveyance path 36 extends in the left-right direction 8 in the casing 61. The toner conveyance path 36 is sectioned into four passages respectively in correspondence with the four toner containers 3. Adjacent portions of the passages are sealed with a seal member 37 such that toners of the respective colors do not mix with each other in the toner conveyance path 36.

As shown in FIG. 7, a spiral conveyance member 65 configured to convey the toner in the toner conveyance path 36, is provided inside the casing 61. The conveyance member 65 is provided in the toner conveyance path 36. The conveyance member 65 is a spiral shaft member where a spiral blade is provided around a rotary shaft that extends along the longitudinal direction (left-right direction 8) of the toner conveyance path 36. When the conveyance member 65 rotates upon receiving a driving force, the conveyance member 65 conveys the toner in one direction along the toner conveyance path 36. In the present embodiment, the conveyance member 65 conveys the toner supplied from the toner container 3 through the reception port 38 described below, toward a communication port 39 of the toner guide 62, wherein the communication port 39 is described below. The toner conveyed to the communication port 39 is guided by the toner guide 62 to drop down, passes through a lower supply port 66 (a toner supply port) at the lower end to reach the replenishment port 44C, and enters the developing device 44 through the replenishment port 44C.

As shown in FIG. 8 and FIG. 9, a plurality of reception ports 38 (an example of an opening of the present disclosure) are provided at an upper portion of the casing 61. The reception ports 38 are openings into which the toner is flowed from the toner containers 3. In the present embodiment, four reception ports 38 are provided in correspondence with the four toner containers 3, at the upper portion of the casing 61. The reception ports 38 are formed in an upper surface of the first casing 611. The reception ports 38 are disposed at predetermined intervals along the left-right direction 8 at the upper portion of the casing 61. The reception ports 38 pass through an upper wall of the casing 61 downward to communicate with the toner conveyance path 36. The toner supplied from the toner containers 3 is flowed into the reception ports 38. The guide passage 38A (see FIG. 7) is formed between each reception port 38 and the toner conveyance path 36 in such a way as to guide the toner supplied from the corresponding toner container 3, from the reception port 38 to the toner conveyance path 36. A configuration including the reception ports 38 and the guide passages 38A corresponds to a toner guide portion of the present disclosure.

Each reception port 38 is positioned in such a way as to communicate with the toner discharge port 32 (see FIG. 7) formed in the corresponding toner container 3, in the attachment state (hereinafter referred to as a container attachment state) where the corresponding toner container 3 is attached to the container attachment portion 30. That is, in the container attachment state, the reception port 38 is disposed below the toner discharge port 32. It is noted that in the container attachment state, the toner discharge port 32 is brought into tight contact with the reception port 38 to prevent leakage of the toner from the toner discharge port 32.

In addition, four communication ports 39 are formed in a lower wall 61A (see FIG. 7) of the casing 61. The communication ports 39 are provided in correspondence with the passages of the toner conveyance path 36 for the respective colors of toner. As shown in FIG. 7, the toner guides 62 are provided respectively in correspondence with the communication ports 39.

Figure 11:
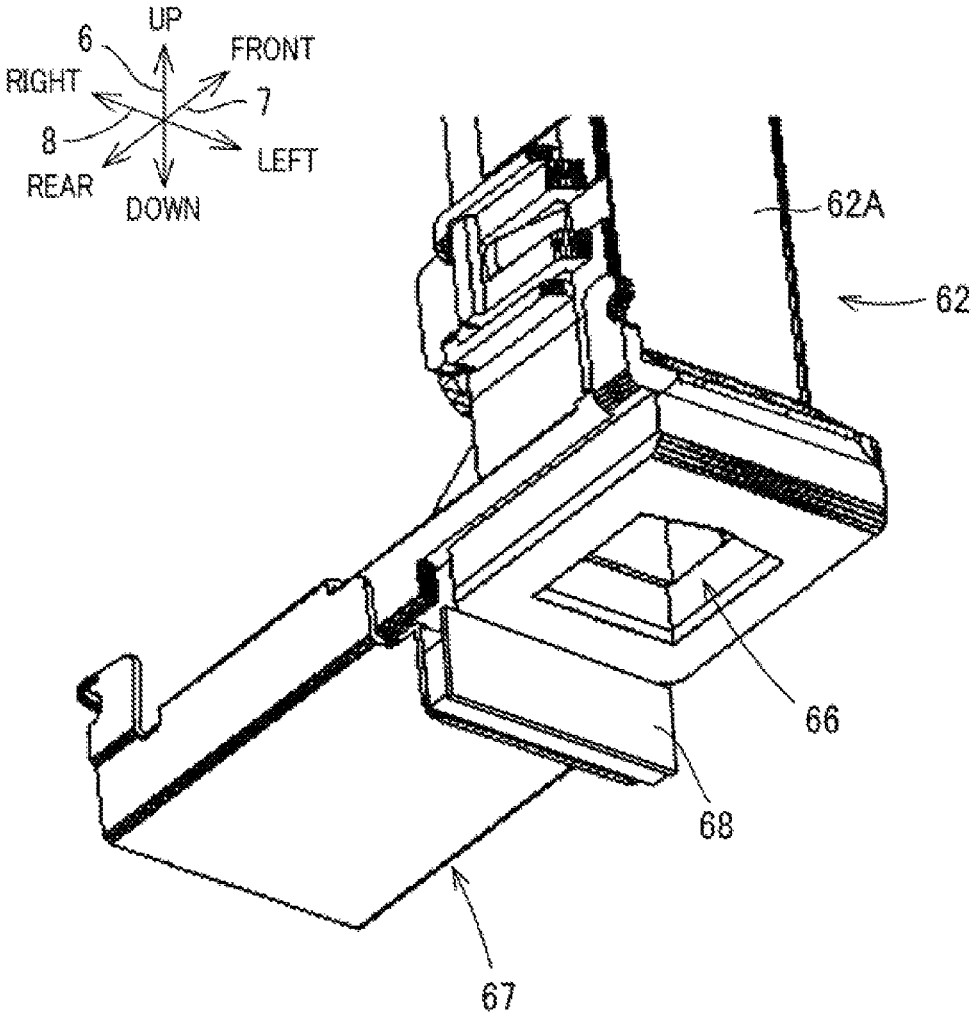
FIG. 11 is a perspective diagram of a toner guide included in the toner conveying device.

FIG. 11 is an enlarged perspective diagram of the toner guide 62. The toner guide 62 includes a tubular guide portion 62A of a rectangular shape in cross section that extends downward from the communication port 39. The inside of the guide portion 62A is a passage in which the toner is guided downward. An upper end of the toner guide 62 is coupled with the communication port 39. A lower supply port 66 is formed at a lower end portion of the toner guide 62. The toner that has flowed from the communication port 39 into the toner guide 62 is guided by the guide portion 62A in such a way as to move downward by the weight of itself.

A shutter member 67 is provided at the lower end portion of the toner guide 62. The shutter member 67 is configured to open and close the lower supply port 66, and is supported by the lower end portion of the toner guide 62 in such a way as to slide between a closing position for closing the lower supply port 66 and an opening position for opening the lower supply port 66 (the position shown in FIG. 11). The shutter member 67 is biased by a spring member (not shown) in a closing direction directed from the opening position to the closing position. When the developing device 44 is attached to the attachment position in the housing 11, a part of the developing device 44 presses an abutting portion 68 of the shutter member 67 rearward. Upon receiving this pressing force, the shutter member 67 moves in an opening direction directed from the closing position to the opening position against the biasing force of the spring member. This opens the lower supply port 66, allowing the toner that has moved downward in the toner guide 62 to flow into the developing device 44.

Meanwhile, the plurality of reception ports 38 are configured to receive the toner supplied from the toner containers 3 and guide the toner to the toner conveyance path 36 in the apparatus. In this configuration, the toner may adhere and deposit on inner surfaces of the guide passages 38A through which the toner moves from the reception ports 38 to the toner conveyance path 36, and the deposited toner may interfere the toner from moving through the guide passages 38A. In the present embodiment, vibration units 70 described below are attached to the casing 61 so that vibration motors 72 that are smaller in number than the installed reception ports 38, can transmit appropriate vibration to all of the plurality of reception ports 38 and the plurality of guide passages 38A to effectively remove the toner deposits deposited on the inner surfaces of the plurality of guide passages 38A.

[Vibration Unit 70]

Figure 12:
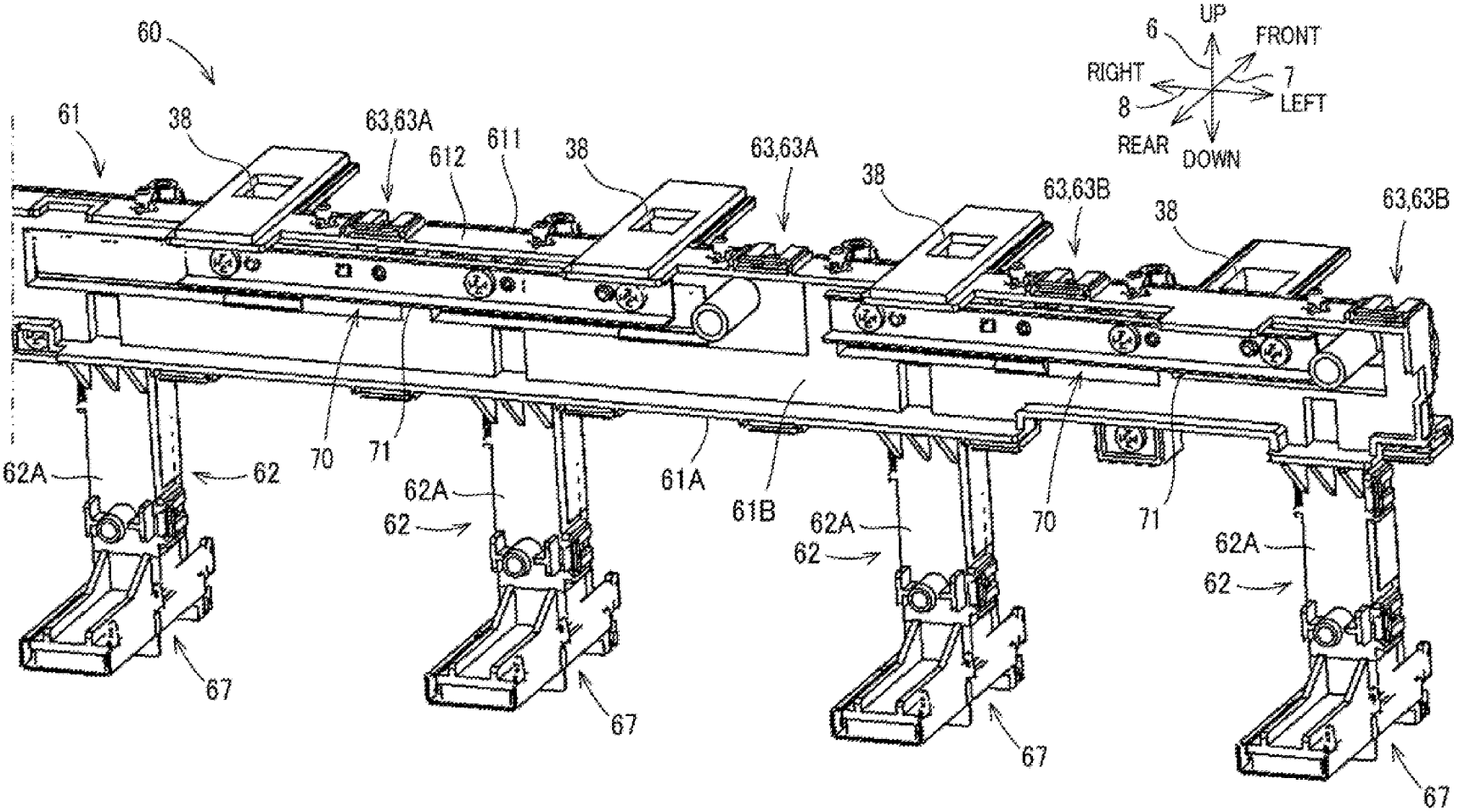
FIG. 12 is a perspective diagram showing a side configuration of the casing included in the toner conveying device.
Figure 13:
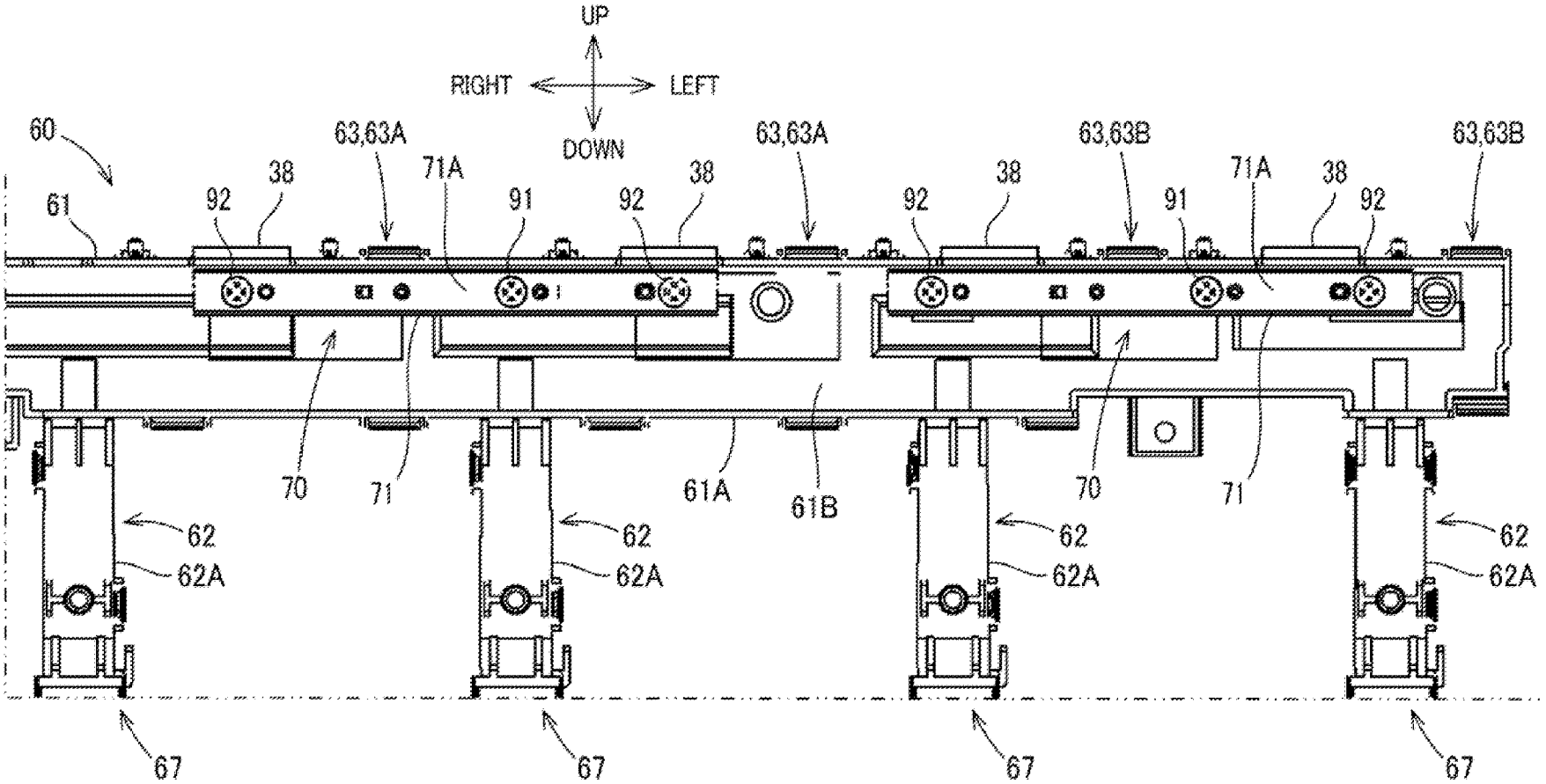
FIG. 13 is a side diagram showing a side configuration of the casing included in the toner conveying device.
Figure 14:
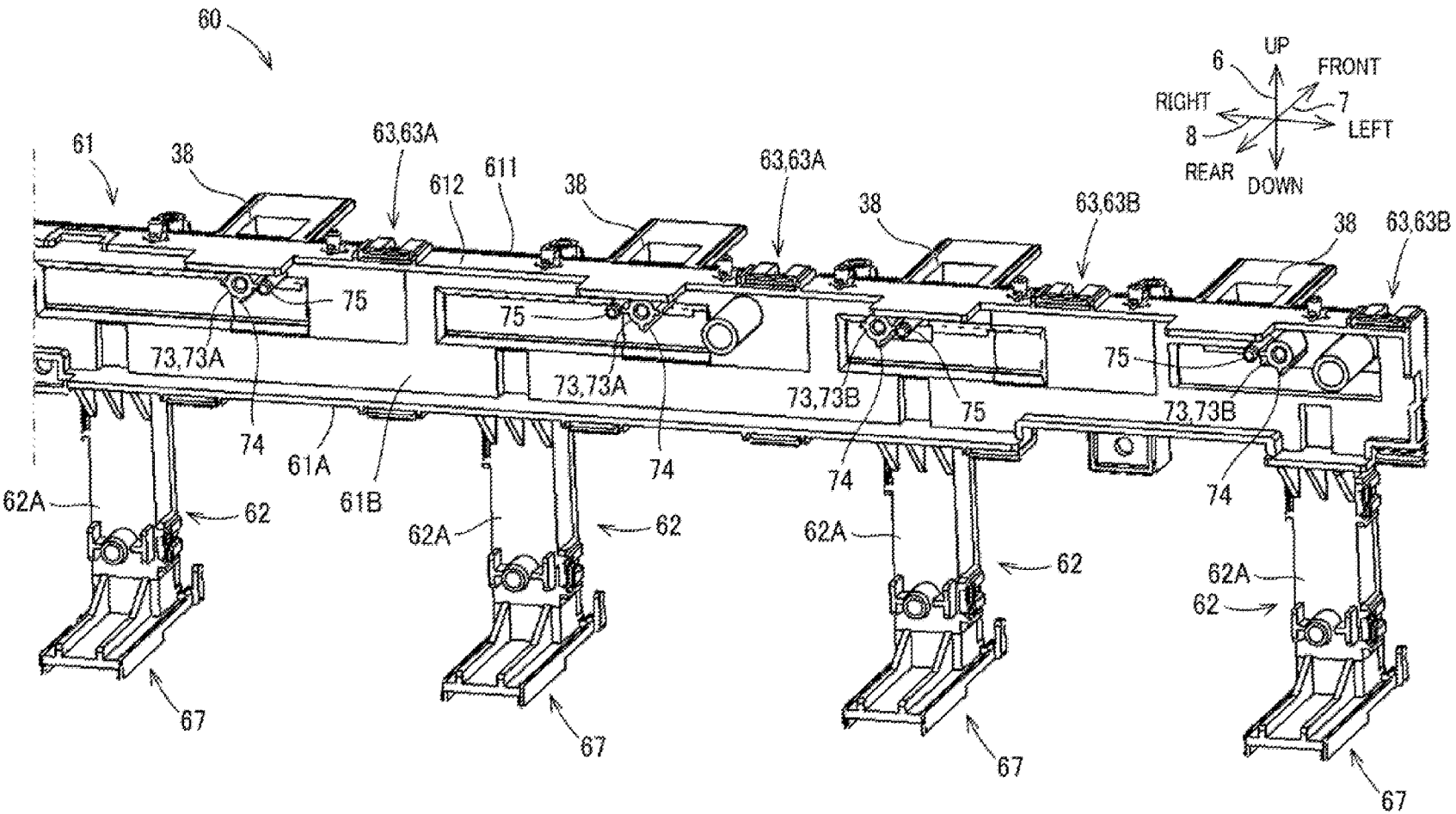
FIG. 14 is a perspective diagram showing a state where vibration units have been removed from the casing included in the toner conveying device.

FIG. 12 to FIG. 14 are diagrams showing a configuration of a side of the casing 61. FIG. 14 shows a state where the vibration units 70 have been removed from the casing 61. As shown in at least FIG. 12, the vibration units 70 are provided on a side surface 61B of the casing 61 at the rear side thereof, namely, the side surface 61B of the second casing 612 at the rear side thereof. In the present embodiment, the two vibration units 70 have the same configuration, and are provided on the side surface 61B of the casing 61 at a predetermined interval in the longitudinal direction of the casing 61.

The two vibration units 70 are configured to give an appropriate vibration to all of the four reception ports 38 and the four guide passages 38A to prevent the toner from depositing in the four reception ports 38 and the four guide passages 38A. Each of the vibration units 70 includes a bracket 71 and a vibration motor 72 (a vibration generating portion).

The bracket 71 is fixed to the side surface 61B via bosses 73 (an example of a leg portion of the present disclosure) provided on the side surface 61B, wherein the bosses 73 are described below. The bracket 71 is made of a material that has a larger characteristic frequency than the casing 61, and, in the present embodiment, formed in a plate shape from a sheet metal member made of a carbon steel, an alloy steel or the like. The bracket 71 is formed to be elongated in the longitudinal direction of the casing 61. In addition, opposite end portions (an upper end portion and a lower end portion) of the bracket 71 opposite in the short direction are bent outward by 90 degrees for the bracket 71 to have higher strength and rigidity.

Figure 15:
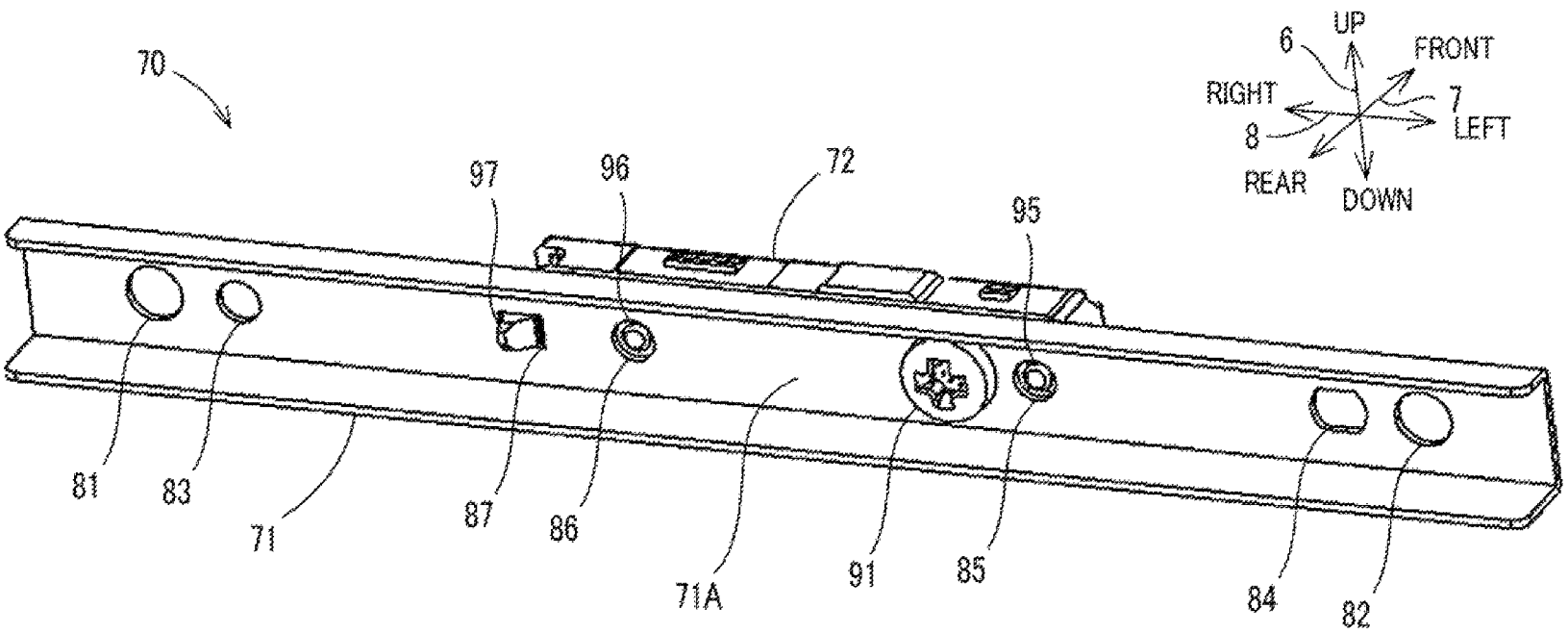
FIG. 15 is a perspective diagram showing a single vibration unit included in the toner conveying device.
Figure 16:
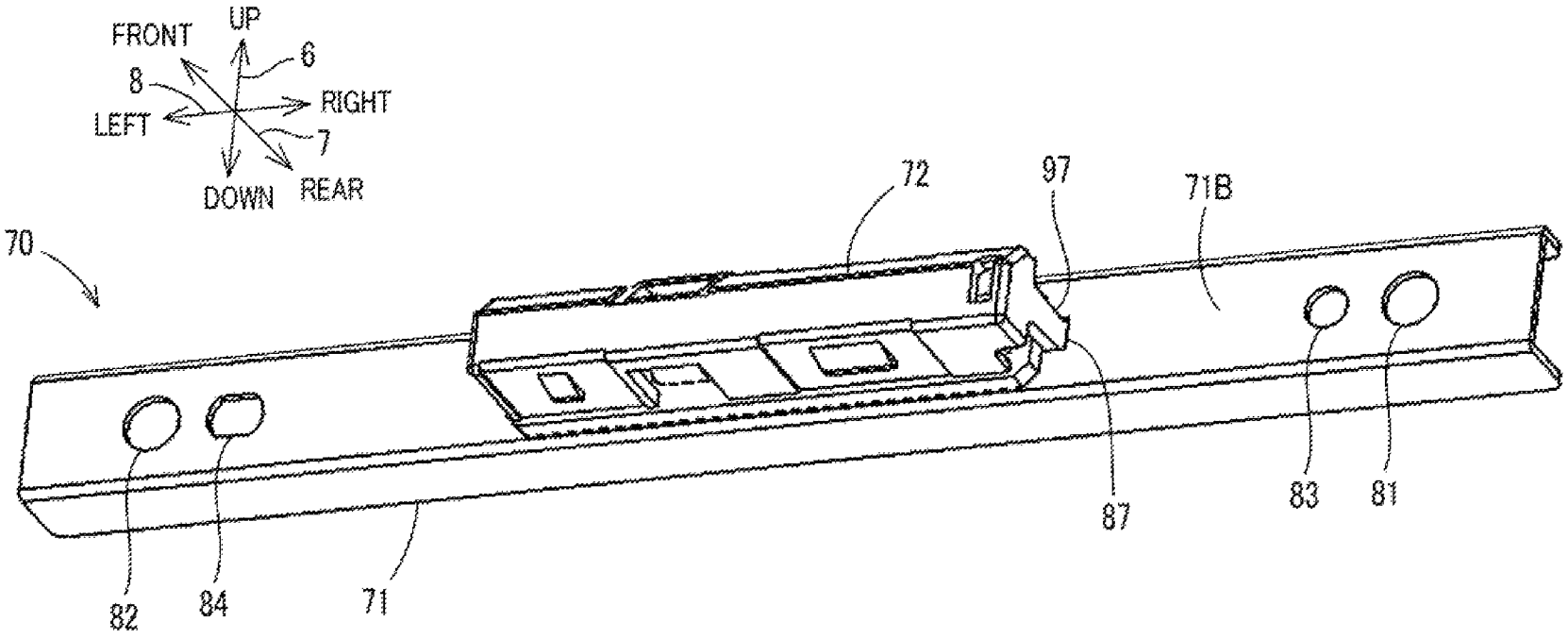
FIG. 16 is a perspective diagram showing the vibration unit included in the toner conveying device.
Figure 17:
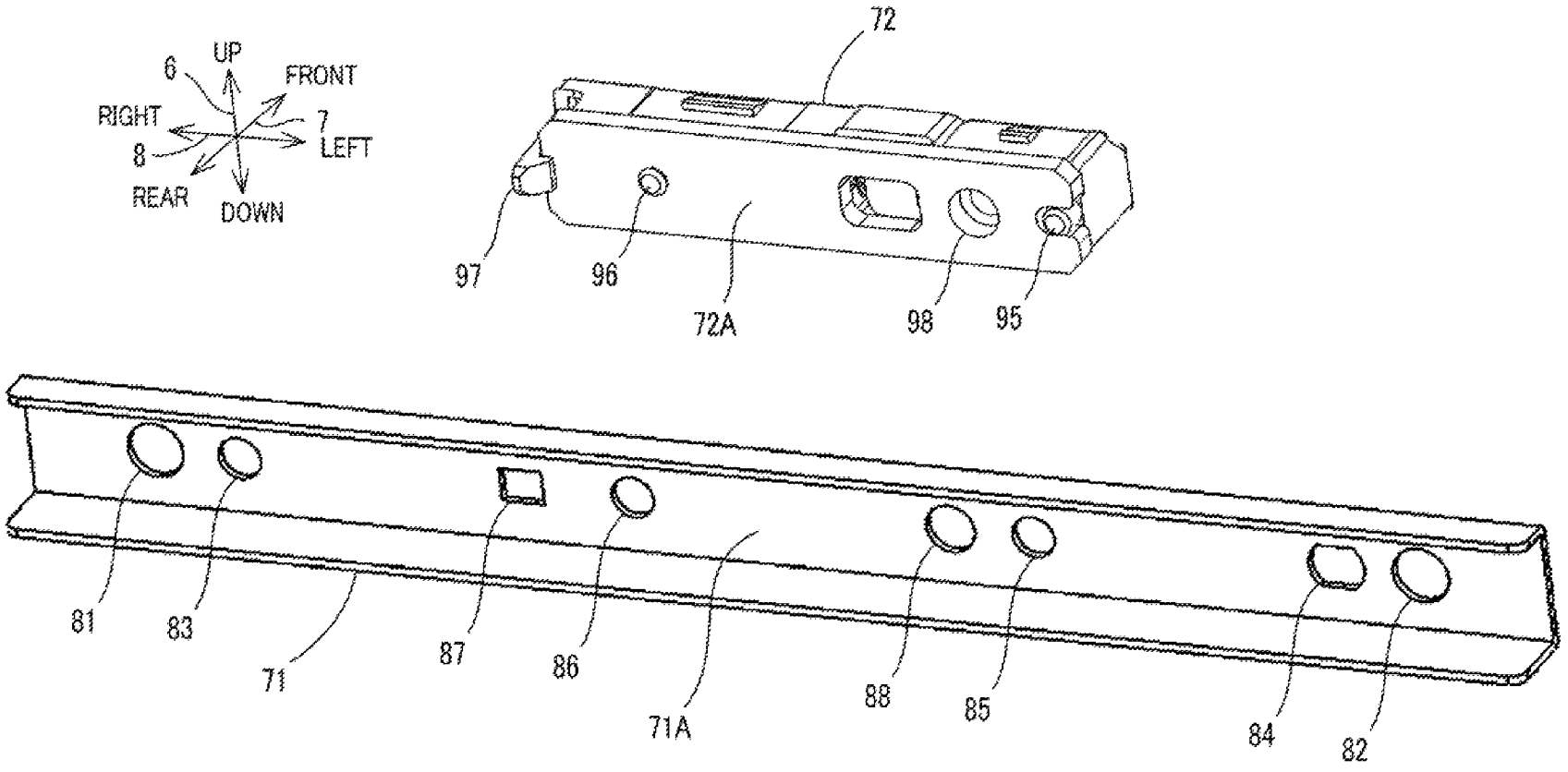
FIG. 17 is an exploded diagram of the vibration unit included in the toner conveying device.

FIG. 15 and FIG. 16 are perspective diagrams showing a single vibration unit 70. FIG. 17 is an exploded perspective diagram of the vibration unit 70. As shown in at least FIG. 15, a plurality of openings 81 to 88 are formed in a side surface 71A of the bracket 71 at one side (the rear side) thereof to pass through the bracket 71. The openings 81 and 82 are formed at opposite end portions of the bracket 71 opposite in the longitudinal direction thereof. An opening 83 is formed in the vicinity of the opening 81 at one end, wherein the opening 83 is smaller in diameter than the opening 81. In addition, an opening 84 is formed in the vicinity of the opening 82 at the other end, wherein the opening 84 is smaller in diameter than the opening 82. The openings 83 and 84 are used to temporarily fix the bracket 71 to the side surface 61B of the casing 61. The openings 81 and 82 are used to fix the bracket 71 that has been temporarily fixed, to the side surface 61B by screws 92 (see FIG. 13) or the like.

As shown in FIG. 16, the vibration motors 72 are attached to a side surface 71B (an example of a facing surface) of the bracket 71 at the other side (the front side) thereof. That is, the vibration motors 72 are disposed in a space between the side surface 71B and the side surface 61B. Each of the vibration motors 72 of the two vibration units is composed of, for example, an output shaft of a DC motor and an eccentric weight fixed to the output shaft, and is driven by a DC current supplied thereto by the control of the control portion 35 (see FIG. 3). When the vibration motor 72 is rotationally driven and the eccentric weight rotates, vibration is generated. The vibration is transmitted to the side surface 61B of the casing 61 via the bracket 71 and the bosses 73. It is noted that the vibration motor 72 is merely an example of the vibration generating portion, and any configuration is applicable as far as it can generate vibration.

As shown in FIG. 17, three positioning pins 95 to 97 are formed in an attachment surface 72A of each vibration motor 72. The positioning pins 95 to 97 of the vibration motor 72 are inserted in the openings 85 to 87 formed in the bracket 71 to temporarily fix the vibration motor 72 to the side surface 71B of the bracket 71. In this temporarily fixed state, a screw 91 (see FIG. 15) is screwed through the opening 88 to a screw hole 98 formed in the vibration motor 72. This allows the vibration motor 72 to be firmly fixed to the side surface 71B of the bracket 71.

As shown in FIG. 14, four cylindrical bosses 73 are provided in the side surface 61B of the casing 61. In other words, the bosses 73 are provided in the side surface 61B of the second casing 612 at the rear side thereof. The bosses 73 support the bracket 71. The bosses 73 project outward (rearward) from the side surface 61B of the casing 61. The bosses 73 are provided on the side surface 61B at predetermined intervals in the longitudinal direction of the casing 61. One of the two vibration units 70 is attached to a pair of bosses 73A on the right side among the four bosses 73, and the other of the two vibration units 70 is attached to a pair of bosses 73B on the left side. The interval between the pair of bosses 73A is the same as the interval between the pair of bosses 73B.

Reinforcement ribs 74 are formed on each of the bosses 73. One or more reinforcement ribs 74 are formed on the outer peripheral surface of each boss 73. The reinforcement ribs 74 extend in a projection direction of each boss 73.

A positioning pin 75 for temporary fixation is provided in the vicinity of each boss 73. The positioning pins 75 are integrally formed with the casing 61. The positioning pins 75 are inserted in the openings 82 and 83 of the bracket 71 so that the vibration unit 70 is temporarily fixed to the side surface 71A of the bracket 71. In this temporarily fixed state, the screws 92 (see FIG. 13) are screwed through the opening 81 and 82 to screw holes formed in the corresponding bosses 73. This allows the vibration unit 70 to be firmly fixed to the side surface 61B of the casing 61.

The bosses 73 are integrally formed with the casing 61. That is, the bosses 73 are made of the same material as the casing 61. The bosses 73 are provided on the upper end portion of the side surface 61B of the casing 61 at positions corresponding to the reception ports 38. In addition, all the four bosses 73 have the same projection length. In the present embodiment, the bosses 73 are fixed to the casing 61 at positions in the vicinity of the plurality of reception ports 38. Specifically, the pair of bosses 73A are provided directly below the corresponding reception ports 38, and the pair of bosses 73A are provided in the vicinity of the corresponding reception ports 38. In addition, in the present embodiment, the bosses 73 are provided in the vicinity of the coupling portions 63.

In the toner conveying device 60 of the present embodiment, the vibration units 70 with the above-described configuration are fixed to the side surface 61B of the casing 61 provided in the toner conveying device 60. Accordingly, when the vibration motors 72 of the vibration units 70 are driven by the control portion 35, the vibration generated by the vibration motors 72 is transmitted to the side surface 61B of the casing 61 via the bracket 71 and the bosses 73. As described above, the bosses 73 are fixed to the casing 61 at positions in the vicinity of two reception ports 38. Accordingly, the vibration transmitted from the bosses 73 to the casing 61 is transmitted to the corresponding two reception ports 38 and the guide passages 38A without being greatly damped. As a result, it is possible to effectively remove the toner deposits deposited in the corresponding two reception ports 38 and the guide passages 38A, and restrict the toner from adhering to the inner surfaces of the reception ports 38 and the guide passages 38A. In addition, according to the above-described vibration units 70, it is possible to transmit vibration of one vibration motor 72 to corresponding two reception port 38 and two guide passages 38A. As a result, it is possible to reduce the number of installed vibration motors 72, compared to a case where the vibration motor 72 is provided at each of the plurality of reception ports 38 and the plurality of guide passages 38A.

In addition, in the present embodiment, the vibration motors 72 are attached to the side surface 71B of the bracket 71, and the vibration motors 72 are disposed in a space between the side surface 71B of the bracket 71 and the side surface 61B of the casing 61. With this configuration where the vibration motors 72 are not exposed to outside of the casing 61, it is possible to reduce a space outside the side surface 61B of the casing 61. In addition, the brackets 71 protect the vibration motors 72 against external impact or the like.

In addition, in the above-described embodiment: the casing 61 is composed of the first casing 611 and the second casing 612 that are coupled with each other in the front-rear direction 7; the reception ports 38 and the guide passages 38A are provided in the first casing 611; and the bosses 73 are provided on the side surface 61B of the second casing 612. In addition, in such a configuration, the bosses 73 are provided on the upper end portion of the side surface 61B at positions corresponding to the reception ports 38 and the guide passages 38A, and the coupling portions 63 are provided in the vicinity of the reception ports 38 and the guide passages 38A. With this configuration, the vibration of the vibration units 70 is transmitted to the reception ports 38 and the guide passages 38A through two paths. That is, the vibration from the bosses 73 is transmitted through the second casing 612, a joint portion (not shown) joined with the second casing 612, and the first casing 611 to the reception ports 38 and the guide passages 38A. In addition, the vibration from the bosses 73 is transmitted through the second casing 612, the coupling portions 63, and the first casing 611 to the reception ports 38 and the guide passages 38A. In this way, since the vibration is transmitted to the reception ports 38 and the guide passages 38A through two paths, it is possible for the casing 61 that is composed of two members as described above, to effectively transmit the vibration of the vibration units 70 to the reception ports 38 and the guide passages 38A.

The above-described embodiment discloses, as one example, a configuration where two vibration units 70 are installed in correspondence with four reception ports 38 and four guide passages 38A. However, the present disclosure is not limited to the configuration. For example, the vibration unit 70 may include one elongated bracket supported by four bosses 73, and one or two vibration motors fixed to the bracket.

In addition, the above-described embodiment discloses, as one example, a configuration where the vibration units 70 are attached to the side surface 61B of the casing 61. However, the present disclosure is not limited to the configuration. For example, the vibration units 70 may be attached to a side surface of the casing 61 opposite to the side surface 61B.

Furthermore, the above-described embodiment discloses, as one example, a configuration where the casing 61 is divided into the first casing 611 and the second casing 612. However, the present disclosure is not limited to the configuration. For example, the present disclosure is applicable to a configuration where the casing 61 is integrally formed as one piece, not dividable.

Meanwhile, in a configuration where a plurality of vibration motors 72 apply vibrations to a plurality of reception ports 38 and a plurality of guide passages 38A, if the vibrations of the plurality of vibration motors 72 are in the same cycle and phase, the vibrations resonate. On the other hand, if the vibrations of the plurality of vibration motors 72 are in the same cycle and in opposite phases, the vibrations are cancelled each other and damped. In the present embodiment, the vibration motors 72 are driven and controlled by the control portion 35 so that the vibrations are applied to the transmission destination in a stable manner.

Figure 19A:
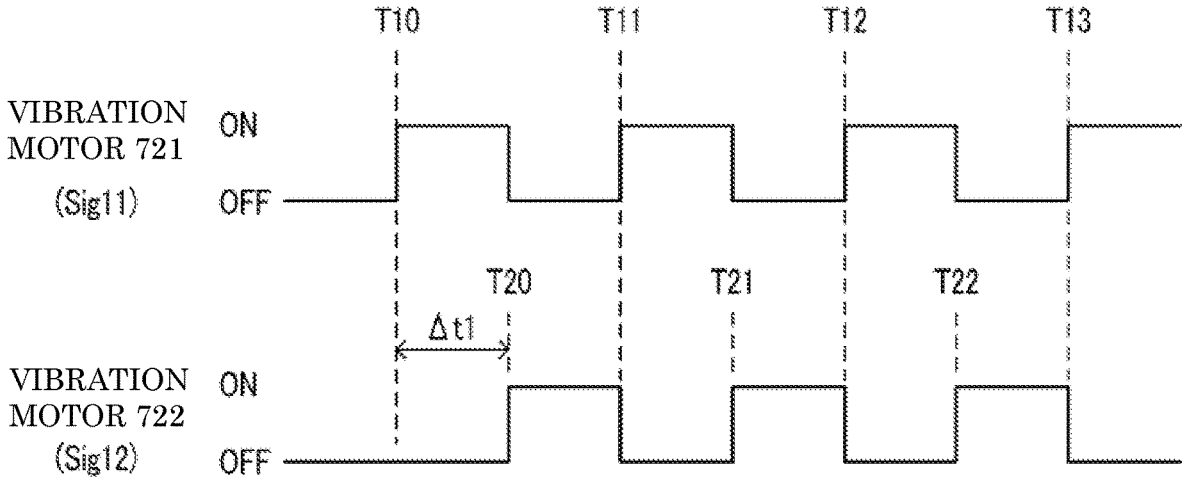
FIG. 19A to FIG. 19C are diagrams showing waveforms of drive signals applied from the control portion to the vibration motors.

Specifically, as shown in FIG. 19A, the control portion 35 drives and controls vibration motors 721 and 722 in such a way as to start them at different timings, and after the start, intermittently drive them at predetermined intervals. For example, the control portion 35 outputs a drive signal Sig11 to the vibration motor 721 at a time point T10 to start the vibration motor 721, and the control portion 35 outputs a drive signal Sig12 to the vibration motor 722 at a time point T20, delayed by a time period Δt1 from the time point T10, to start the vibration motor 722. Specifically, the control portion 35 includes switching elements (not shown) that respectively correspond to the drive signals Sig11 and Sig12, and output the drive signals Sig11 and Sig12 at different timings by controlling the ON/OFF timing of the switching elements. Here, as another example, a delay circuit (not shown) having a predetermined time constant may be placed on a signal line between the control portion 35 and the vibration motor 722 to make the output timings of the drive signals Sig11 and Sig12 different. In this case, it is possible to adjust the difference in the start timing of the vibration motors 721 and 722 by setting an appropriate value to the time constant of the delay circuit.

In the example shown in FIG. 19A, the driving signals Sig11 and Sig12 respectively output to the vibration motors 721 and 722 are rectangular wave signals (pulse signals) with a duty ratio of 50%, and the time period Δt1 is equal to an interval between the rising and falling of each rectangular wave (a duration in which the pulse is ON). With such a driving control, the vibration motor 722 stops while the vibration motor 721 is vibrating (driving), and the vibration motor 721 stops while the vibration motor 722 is vibrating (driving). The vibration motors 721 and 722 repeat vibrating and stopping in this way until the control portion 35 stops outputting the drive signals thereto.

Figure 19B:
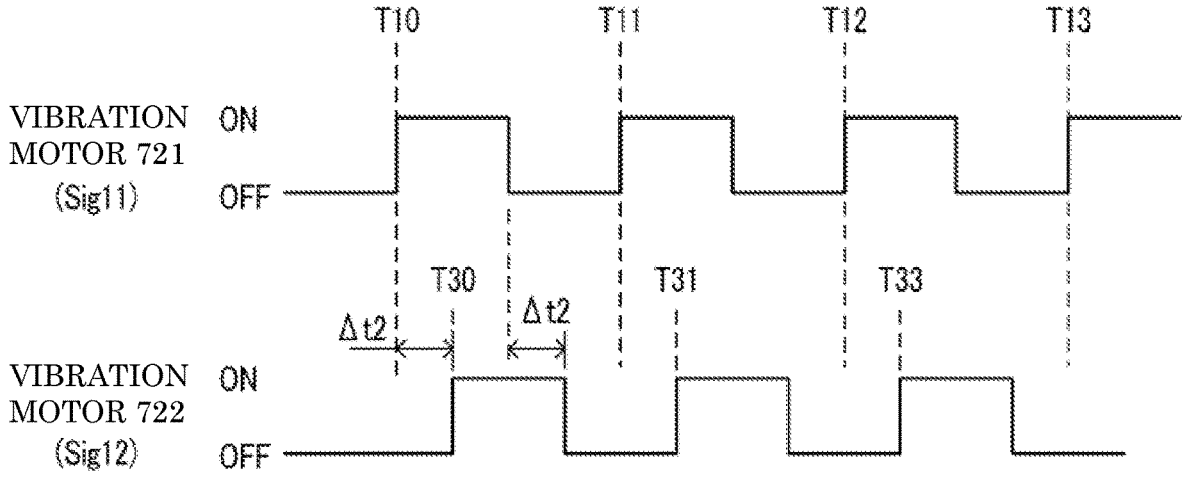

In addition, as shown in FIG. 19B, the control portion 35 outputs the drive signal Sig11 to the vibration motor 721 at the time point T10 to start the vibration motor 721, and outputs the drive signal Sig12 to the vibration motor 722 at a time point T30, delayed by a time period Δt2 from the time point T10, to start the vibration motor 722. In the example shown in FIG. 19B, too, the driving signals Sig11 and Sig12 output to the vibration motors 721 and 722 are rectangular wave signals (pulse signals) with a duty ratio of 50%. However, the time period Δt2 is half the interval between the rising and falling of each rectangular wave (the duration in which the pulse is ON). With such a driving control, the vibration motor 722 stops when the vibration motor 721 starts vibrating (driving), and the vibration motor 722 starts vibrating (driving) when the time period Δt2 has elapsed since the start of the vibration motor 721. Subsequently, when the time period Δt2 has further elapsed, the vibration motor 721 stops vibrating, and then when the time period Δt2 has further elapsed, the vibration motor 722 stops vibrating, too. The vibration motors 721 and 722 repeat vibrating and stopping in this way until the control portion 35 stops outputting the drive signals thereto.

Figure 19C:
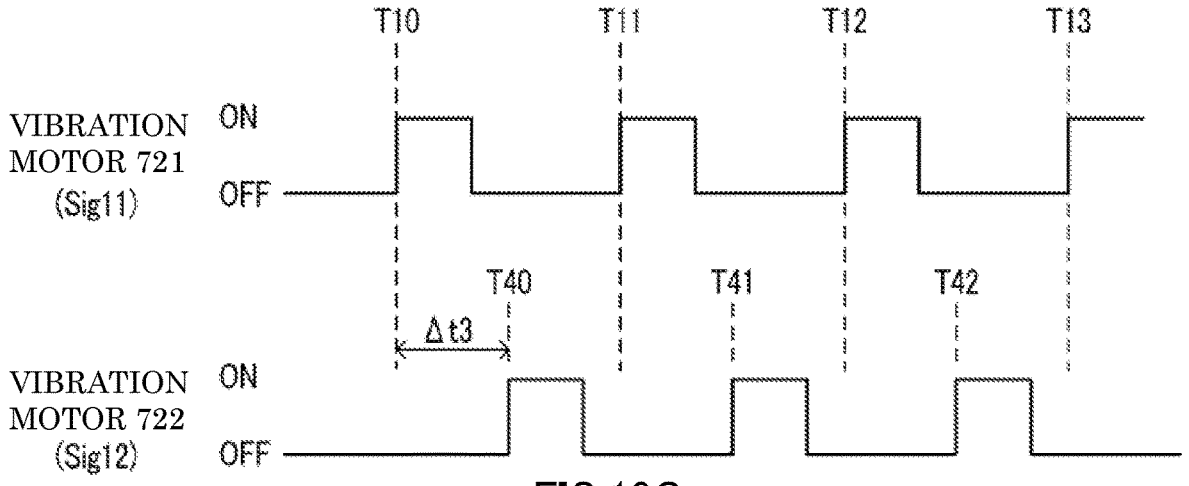

In addition, as shown in FIG. 19C, the control portion 35 outputs the drive signal Sig11 to the vibration motor 721 at the time point T10 to start the vibration motor 721, and outputs the drive signal Sig12 to the vibration motor 722 at a time point T40, delayed by a time period Δt3 from the time point T10, to start the vibration motor 722. In the example shown in FIG. 19C, the driving signals Sig11 and Sig12 output to the vibration motors 721 and 722 are rectangular wave signals (pulse signals) with a duty ratio of less than 50%, and the time period Δt3 is longer than the interval between the rising and falling of each rectangular wave (the duration in which the pulse is ON). With such a driving control, the vibration motor 722 stops during a time period in which the vibration motor 721 vibrates (drives) and stops, and the vibration motor 722 starts vibrating (driving) after the vibration motor 721 stops completely. Subsequently, the vibration motor 721 stops during a time period in which the vibration motor 722 vibrates (drives) and stops, and the vibration motor 721 starts vibrating (driving) after the vibration motor 722 stops completely. The vibration motors 721 and 722 repeat vibrating and stopping in this way until the control portion 35 stops outputting the drive signals thereto.

Second Embodiment

Next, a second embodiment of the present disclosure is described with reference to FIG. 20. In the present embodiment, the control portion 35 drives and controls the vibration motors 721 and 722 in a different manner from the first embodiment. Otherwise the present embodiment is the same as the first embodiment. As a result, in the following description, components different from those of the first embodiment are described, and description of the other components is omitted.

Figure 20:
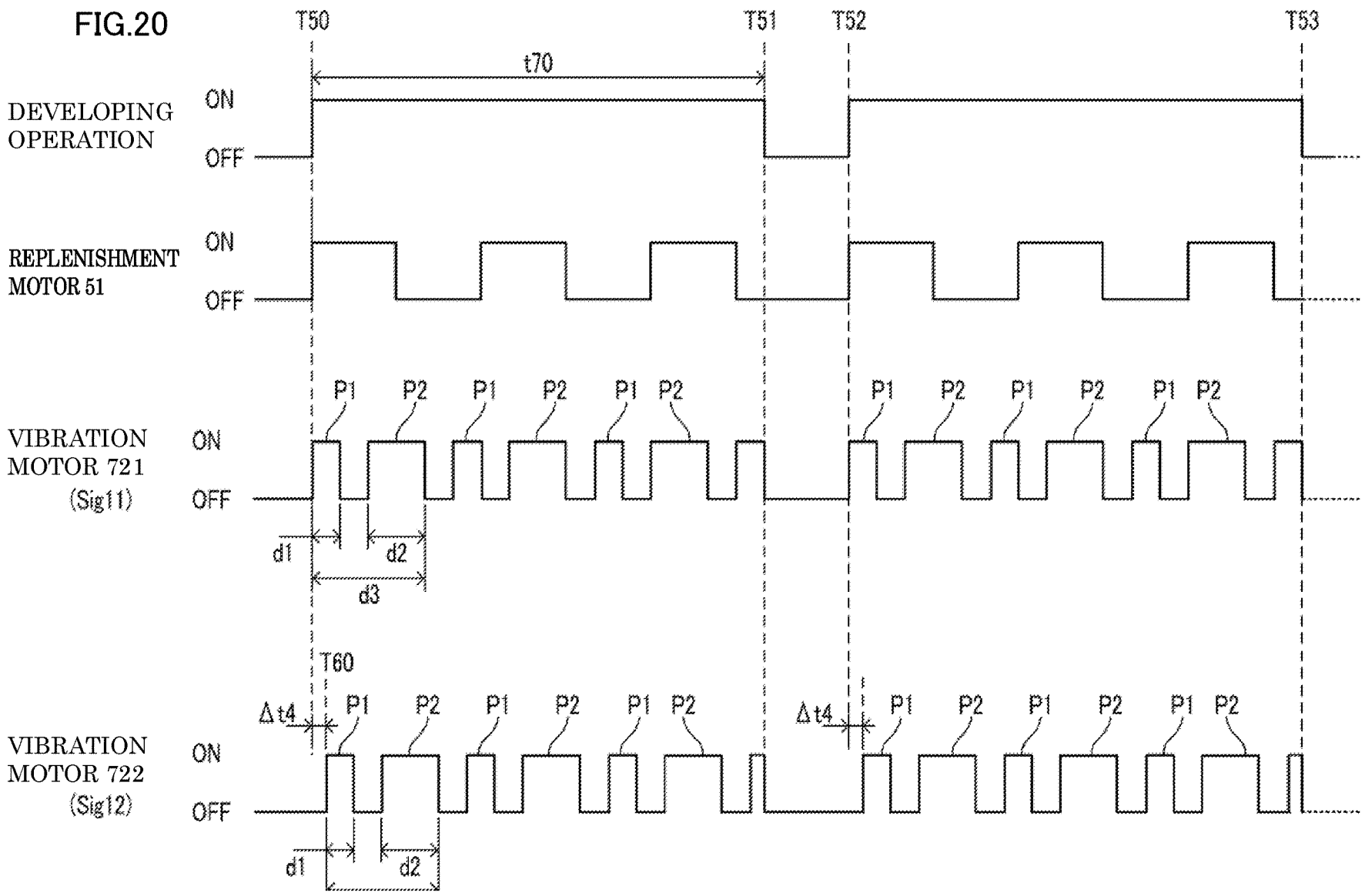
FIG. 20 is a diagram showing a timing chart of a print operation and waveforms of drive signals applied from the control portion to a replenishment motor and the vibration motors.

In the present embodiment, too, as is the case with the first embodiment, as shown in FIG. 20, the control portion 35 drives and controls the vibration motors 721 and 722 in such a way as to start them at different timings, and after the start, intermittently drive them at predetermined intervals. That is, the control portion 35 outputs the drive signal Sig11 to the vibration motor 721 at a time point T50 to start the vibration motor 721, and the control portion 35 outputs the drive signal Sig12 to the vibration motor 722 at a time point T60, delayed by a time period Δt4 from the time point T50, to start the vibration motor 722.

In the present embodiment, each of the driving signals Sig11 and Sig12 output to the vibration motors 721 and 722 from the control portion 35 is a rectangular wave signal (pulse signal) where two rectangular waves of different pulse widths (a first pulse and a second pulse) alternately continue. Here, the pulse width is the interval between the rising and falling of each rectangular wave (the duration in which the pulse is ON). That is, a pulse width d1 of a first pulse P1 is different from a pulse width d2 of a second pulse P2, wherein the first pulse P1 is one of the two rectangular waves and appears first after the start, and the second pulse P2 is the other of the two rectangular waves and appears next. Specifically, the pulse width d1 of the first pulse P1 is shorter than the pulse width d2 of the second pulse P2. In addition, the first pulse P1 and the second pulse P2 alternately appear at a predetermined interval (for example, at an interval that is the same as the pulse width of the first pulse P1).

In the present embodiment, the time period Δt4 is a time difference smaller than an interval d3 between the rising of the first pulse P1 and the falling of the second pulse P2. With this time difference, the vibration motor 721 is started first, and the vibration motor 722 is started next. The time period Δt4 is set to be within a range larger than 0 (zero) and smaller than the interval d3. In the example shown in FIG. 20, the time period Δt4 is set to be a time difference that is half the pulse width d1 of the first pulse P1.

In a case where the vibration motors 721 and 722 are driven and controlled in this way, the vibration motor 722 still stops when the vibration motor 721 starts vibrating (driving) at the time point T50 by the first pulse P1 of the drive signal Sig11. The vibration motor 722 starts vibrating (driving) at the time point T60 by the first pulse P1 of the drive signal Sig12 when the time period Δt4 has elapsed since the start of the vibration motor 721. Subsequently, when the time period Δt4 has further elapsed, the first pulse P1 of the drive signal Sig11 falls and the vibration motor 721 stops vibrating, and then when the time period Δt4 has further elapsed, the first pulse P1 of the drive signal Sig12 falls and the vibration motor 722 stops, too. Subsequently, when the predetermined interval has elapsed since the falls of the drive signals Sig11 and Sig12, the vibration motors 721 and 722 are driven by the second pulse P2 of the pulse width d2. The vibration motor 721 continues to operate by the first pulse P1 and the second pulse P2 until the drive signal Sig11 from the control portion 35 stops at a time point T51, and the vibration motor 722 continues to operate by the first pulse P1 and the second pulse P2 until the drive signal Sig12 stops at a time point T51.

In the present embodiment, the drive signals Sigh 1 and Sig12 are output to the vibration motors 721 and 722 during a developing operation time period t70 in which the developing operation is performed by the image forming units 4 of the image forming apparatus 10. In the example shown in FIG. 20, the drive signal Sig11 is output to the vibration motor 721 at a timing (time point T50) when the developing operation is started, and the output of the drive signals Sig11 and Sig12 is stopped at a timing (time point T51) when the developing operation ends. Here, the developing operation time period t70 is, during an image forming process of forming an image on a sheet member, a time period from when the developing device 44 starts developing the toner image on the photoconductor drum 41 to when the developing device 44 ends the developing. That is, the developing operation time period t70 is a time period in which an operation consuming the toner is performed during the image forming process of forming an image on a sheet member. The toner is consumed during the developing operation. As a result, to prevent the density of the printed surface of the sheet member from decreasing due to the consumption of the toner, the control portion 35 causes the toner containers 3 to replenish the toner to the toner conveying device 60 by outputting the rectangular wave signals shown in FIG. 20 to the replenishment motor 51 during the print operation to intermittently drive the replenishment motor 51. In other words, as shown in FIG. 20, the control portion 35 drives the vibration motors 721 and 722 while the toner replenishment operation is performed, and stops the vibration motors 721 and 722 while the toner replenishment operation is not performed.

As described above, in the toner conveying device 60 of the above-described embodiments, the vibration units 70 with the above-described configuration are fixed to the side surface 61B of the casing 61, and the vibration motors 72 (721, 722) of the vibration units 70 are started at different start timings and are intermittently driven by the control portion 35. Accordingly, the vibrations of the vibration motors 72 are hardly in the same cycle and phase, and the resonance of the vibration hardly continues during the driving of the vibration motors 72.

In addition, the vibrations of the vibration motors 72 are hardly in opposite phases, and the vibrations are not greatly damped while the vibration motors 72 are driven. This makes it possible to transmit, in a reliable manner, appropriate vibrations to all of the plurality of reception ports 38 and the plurality of guide passages 38A that are the vibration transmission destination. As a result, it is possible to effectively remove the toner deposits deposited on the inner surfaces of the plurality of guide passages 38A, or restrict the toner from depositing.

The above-described embodiment discloses, as one example, a configuration where the vibration motor 72 is provided in each of the two vibration units. However, the present disclosure is not limited to the configuration. For example, the present disclosure is applicable to a configuration where the vibration motors 72 are provided in the casing 61 respectively in the vicinity of a plurality of guide passages 38A.

In addition, the above-described embodiment discloses, as one example, a configuration where vibration is applied to a toner guide portion (a configuration including the reception ports 38 and the guide passages 38A) that receives the toner from the toner containers 3 and guides the toner to the toner conveyance path 36. However, not limited to the configuration, the present disclosure is applicable to a configuration where vibration is effectively applied to either the reception ports 38 or the guide passages 38A. In addition, for example, the present disclosure is applicable to a configuration where vibration is applied to the toner guides 62 that guide the toner from the toner conveyance path 36 to the replenishment ports 44C of the developing devices 44 via the communication ports 39 formed in the casing 61. In this case, the toner guides 62 correspond to the toner guide portion of the present disclosure. In addition, the vibration motor 72 is provided in the vicinity of each of the toner guides 62.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A toner conveying device that conveys toner, comprising:

a housing having, inside thereof, a toner conveyance path;

a toner guide portion provided in the housing and including an opening through which toner flows in or out, and a guide passage communicating between the opening and the toner conveyance path; and at least two vibration motors that apply vibrations to the toner guide portion, wherein the vibration motors are started at different timings, and driven and controlled by drive signals in which a first pulse and a second pulse of different pulse widths alternately continue.

2. The toner conveying device according to claim 1, wherein the vibration motors are started with a time difference that is less than an interval between a rising of the first pulse and a falling of the second pulse.

3. The toner conveying device according to claim 1, wherein each of the vibration motors is composed of an output shaft and an eccentric weight attached to the output shaft.

4. An image forming apparatus comprising:

the toner conveying device according to claim 1;

a developing device configured to perform developing by using the toner supplied from the toner conveying device; and a control portion configured to start the vibration motors at different timings, and drive and control the vibration motors by the drive signals in which the first pulse and the second pulse of different pulse widths alternately continue.

5. The image forming apparatus according to claim 4, further comprising:

a toner replenishing device configured to replenish the toner to an opening provided in the toner conveying device, wherein the control portion drives the vibration motors while a toner replenishment operation of replenishing the toner to the opening is performed, and stops the vibration motors while the toner replenishment operation is not performed.

* * * * *